US010022294B2

(12) United States Patent
Meier et al.

(10) Patent No.: US 10,022,294 B2
(45) Date of Patent: Jul. 17, 2018

(54) AUTONOMOUS MECHANICAL CPR DEVICE

(71) Applicants: Giovanni C. Meier, Madison, CT (US); Gintaras A. Vaisnys, Chicago, IL (US); Glenn W. Laub, Princeton, NJ (US); Benny S. Chi, Dumont, NJ (US)

(72) Inventors: Giovanni C. Meier, Madison, CT (US); Gintaras A. Vaisnys, Chicago, IL (US); Glenn W. Laub, Princeton, NJ (US); Benny S. Chi, Dumont, NJ (US)

(73) Assignee: Defibtech, LLC, Guilford, CT (US)

( * ) Notice: Subject to any disclaimer, the term of this patent is extended or adjusted under 35 U.S.C. 154(b) by 647 days.

(21) Appl. No.: 14/523,249

(22) Filed: Oct. 24, 2014

(65) Prior Publication Data

US 2015/0119768 A1 Apr. 30, 2015

Related U.S. Application Data

(60) Provisional application No. 61/895,159, filed on Oct. 24, 2013.

(51) Int. Cl.
*A61H 31/00* (2006.01)

(52) U.S. Cl.
CPC ..... *A61H 31/006* (2013.01); *A61H 31/005* (2013.01); *A61H 31/008* (2013.01); *A61H 2201/0107* (2013.01); *A61H 2201/1246* (2013.01); *A61H 2201/149* (2013.01); *A61H 2201/1685* (2013.01); *A61H 2201/5007* (2013.01)

(58) Field of Classification Search
CPC ..... A61H 31/006; A61H 31/005; A61H 2201/5007; A61H 2201/1685; A61H 2201/149; A61H 2201/1246
See application file for complete search history.

(56) References Cited

U.S. PATENT DOCUMENTS

| | | | | |
|---|---|---|---|---|
| 2,071,215 | A | 2/1937 | Petersen | |
| 3,489,140 | A | 1/1970 | Mullikin | |
| 4,664,098 | A | 5/1987 | Woudenberg et al. | |
| 2003/0181834 | A1 | 9/2003 | Sebelius et al. | |
| 2010/0185127 | A1* | 7/2010 | Nilsson | A61H 31/004 601/41 |
| 2015/0057580 | A1* | 2/2015 | Illindala | A61H 31/006 601/41 |
| 2015/0094624 | A1* | 4/2015 | Illindala | A61H 31/006 601/41 |

FOREIGN PATENT DOCUMENTS

| | | |
|---|---|---|
| EA | 003223 | 2/2003 |
| WO | WO 2009/077967 | 6/2009 |
| WO | WO 2009/136831 | 11/2009 |

OTHER PUBLICATIONS

International Search Report for International Patent Application No. PCT/US2014/062166, dated Jan. 22, 2015.
Extended European Search Report for European Patent Application No. 14855266.4, dated Jun. 28, 2017.

* cited by examiner

*Primary Examiner* — Quang D Thanh
(74) *Attorney, Agent, or Firm* — King & Spalding LLP

(57) ABSTRACT

An autonomous mechanical CPR device is disclosed having a CPR unit attached to a free-standing support assembly. In operation, a victim is placed in the support assembly such that the CPR unit can compress the victim's chest. The CPR device is preferably portable, and it provides the recommended depth of chest compression at the recommended rate.

17 Claims, 31 Drawing Sheets

VIEW B

AUTONOMOUS MECHANICAL CPR DEVICE

RELATED APPLICATIONS

This application claims priority to U.S. Provisional Application 61/895,159 entitled "Autonomous Mechanical CPR Device" filed Oct. 24, 2013. The entire contents of the provisional application mentioned above are hereby incorporated by reference.

TECHNICAL FIELD

The invention relates to kinesitherapy and more specifically to provide cardio pulmonary resuscitation (CPR).

BACKGROUND OF THE INVENTION

Cardio Pulmonary Resuscitation (CPR) is a well-known, first-aid treatment ideally performed on a victim suffering cardiac arrest. CPR is an external heart massage technique that manually preserves blood circulation through a victim's body in an attempt to maintain the body's organs, primarily the brain, until a normal heart rhythm, or blood flow, can be restored.

In the treatment, a person's chest (i.e., sternum) is compressed. The compressions of the chest in turn cause compression of the heart forcing blood to circulate through the cardiovascular system.

Performing manual CPR (i.e., CPR compressions given by a person) is strenuous, even using devices that provide a mechanical advantage. Proper CPR requires about 100, 5-cm-deep compressions of the chest per minute, each compression potentially requiring a force upwards of 550 N. Therefore, maintaining high-quality, manual CPR for an extended period of time, even more than several minutes, can be exhausting. Additionally, as close proximity of the CPR provider to victim is required for manual CPR, maintaining continuous manual CPR is compromised when the victim on whom the CPR is being performed is being moved, whether being carried on a backboard (e.g., through doorways, down halls or on stairs) or transported in a vehicle.

Autonomous mechanical CPR devices, which are well known in the art, can overcome many of the issues associated with providing CPR for extended periods of time. These CPR devices can be associated with a victim and once started do not require human intervention, or even necessitate human proximity, and will continue CPR as long as their power source permits.

Autonomous mechanical CPR devices generally comprise a support assembly having a CPR unit (i.e., a device capable of compressing a chest) defining a freestanding structure. The support assembly typically mounts to a back plate, which is positioned under a victim, with the support assembly extending over the victim. In other words, the support assembly and back plate define an opening in which the victim is placed.

What is needed in the art are autonomous mechanical CPR devices that are easy to store and deploy, and are compatible with a broad spectrum of body types.

SUMMARY OF THE INVENTION

The invention is an autonomous mechanical CPR device. The device has a CPR unit attached to a free-standing support assembly. In operation, a victim is placed in the support assembly such that the CPR unit can compress the victim's chest. The CPR device is preferably portable, and it provides the recommended depth of chest compression at the recommended rate.

As an optional feature, the CPR device may include the ability to adjust the support assembly to permit the CPR unit to be placed properly relative to a victim's chest. In addition, the CPR unit may contain programming to allow relevant components of the CPR unit to be positioned autonomously by the CPR unit relative to a victim's chest.

These and other aspects and advantages of the invention will become apparent from the following detailed description and the accompanying drawings which illustrate by way of example the features of the invention.

DETAILED DESCRIPTION

Figure 1:
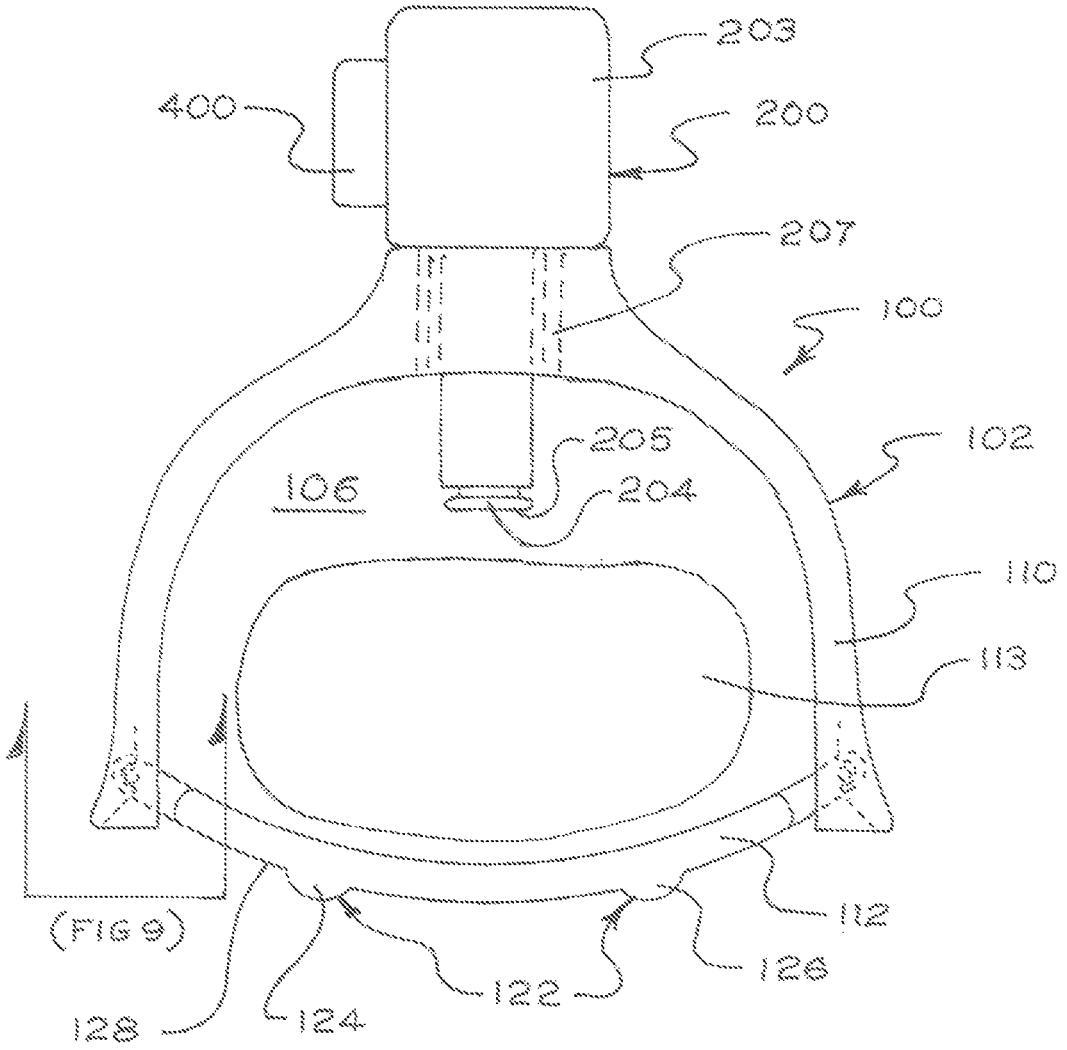
FIG. 1 is a front view drawing of the CPR Device.

As shown in FIG. 1 the CPR device, generally referred to by reference number 100 includes a support assembly (generally referred to by reference number 102), a compression system (generally referred to by reference number 200), a control system (generally referred to by reference number 350), and a power system (generally referred to by reference number 400).

Support Assembly

The support assembly 102 includes an arch 110 that connects to a backplate 112. The arch 110 and backplate 112 cooperate to define an opening 106 suitable in cross-section to allow placement of a victim within the support assembly 102. More specifically, the cross-section of the support assembly 102, in the region under the lowest point of the compression system 200, is sized based on the transverse cross-section of a human torso 113 in the thoracic region at the position of the heart (i.e., when the back is positioned on the back plate and the sternum is under the compression system). The actual size of the cross-section of the support assembly 102 is a matter of design choice; however, a suitable cross-section would allow the CPR device 100 to be used on a substantial portion of the population.

The support assembly 102 is rigid. As used herein, "rigid" means a structure that is not flexible, but may be subject to minor temporary deflections, which may be perceptible or not, when loads are applied under normal operating conditions.

Figure 2:
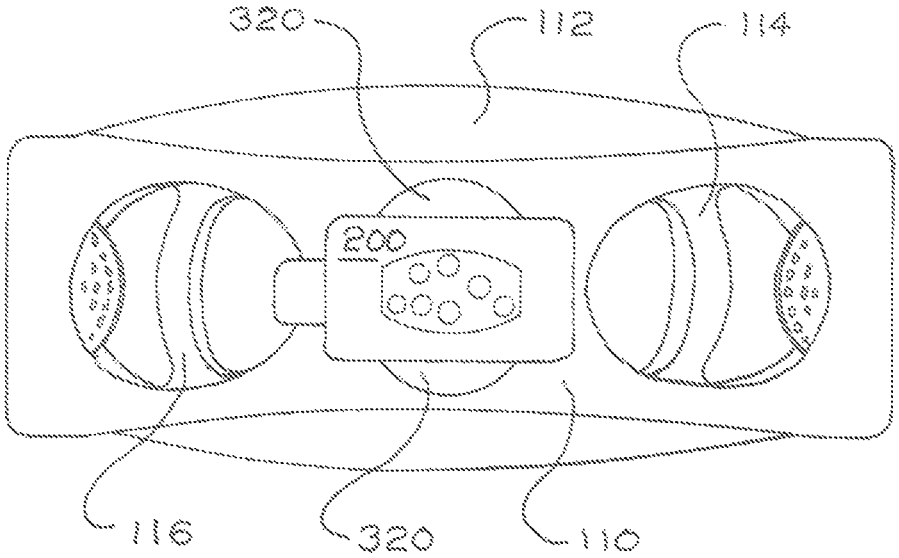
FIG. 2 is a top view drawing of the CPR Device.
Figure 3:
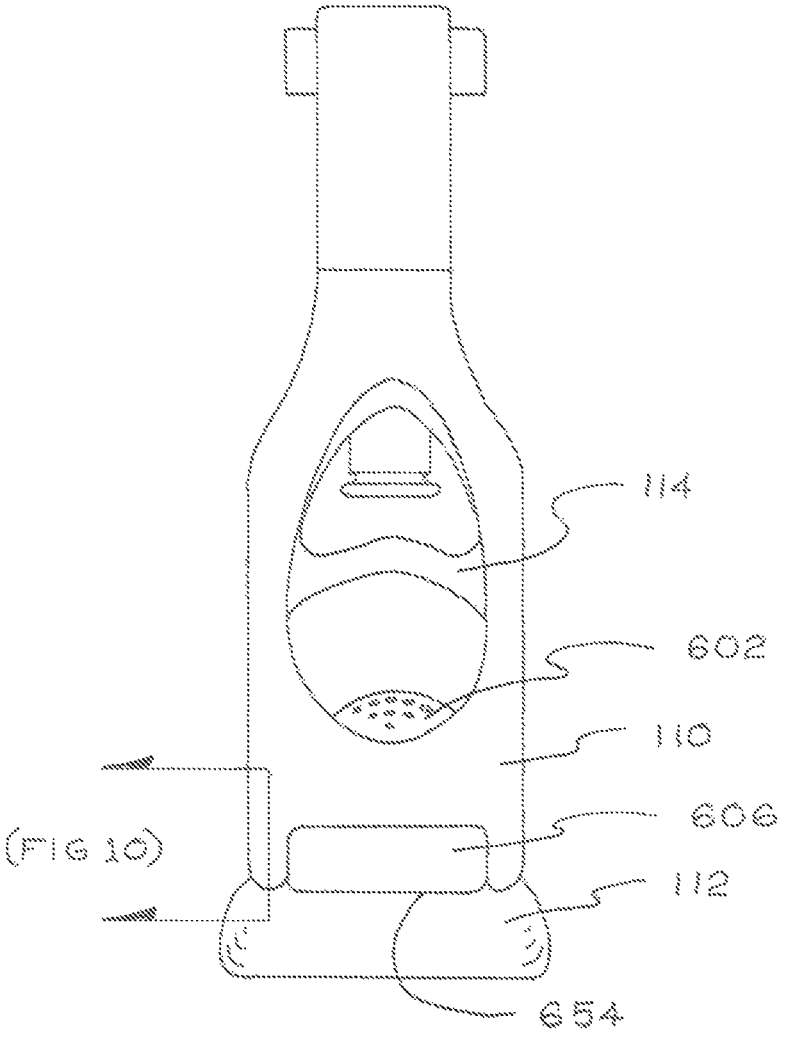
FIG. 3 is a side view drawing of the CPR Device.

As shown in FIGS. 1-3, the arch 110, which is illustrated as generally symmetrical, has handles 114, 116, one on each side. The handles 114, 116 allow a user to grasp the arch 110 to accomplish such actions as disconnecting the arch 110 from the backplate 112, or placing the arch over a victim and connecting it to the backplate, which would be positioned under the victim.

Figure 4:
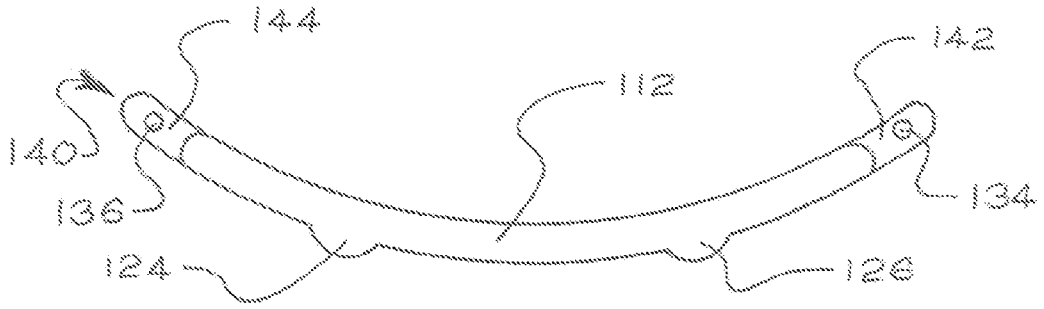
FIG. 4 is a side view drawing of the backplate.
Figure 5:
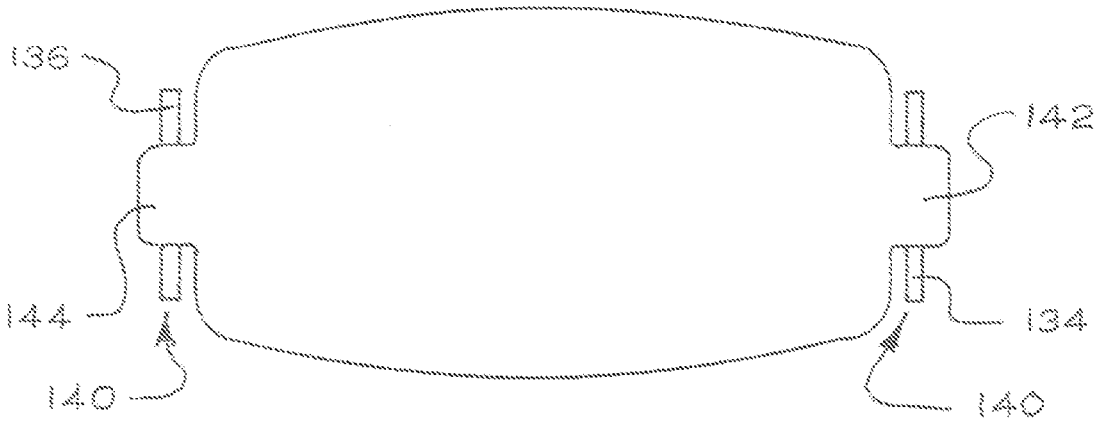
FIG. 5 is a top view drawing of the backplate.

Referring to FIGS. 4 and 5, the backplate 112 preferably has a curvature generally consistent with that of a victim's back. To provide stability to the backplate or to the support assembly 102 when placed on a surface, a passive anti-roll system 122 may be incorporated. The illustrated passive anti-roll system 122 may be a cooperating pair of protrusions 124, 126 extending outwardly from the bottom 128 (the side opposite that in contact with the victim's back) of the backplate 112. Preferably, the protrusions 124, 126 are sized such that when the backplate 112 is placed on a flat surface (not shown) both protrusions are simultaneously in contact with the surface. However, the protrusions 124, 126 maybe sized to work independently in corporation with a portion of the bottom 128.

The backplate 112 further includes tabs 142, 144 that extend outwardly from the ends of backplate. Extending through and outwardly from each tab is a latch pin 134, 136.

The arch 110 is connected to the backplate 112 by a latch system (generally referred to by reference number 140). A first portion of the latch system 140 is located in the arch 110 and a cooperating second portion is located in the backplate 112. In the illustrative example, there are two latch systems 140.

Figure 6:
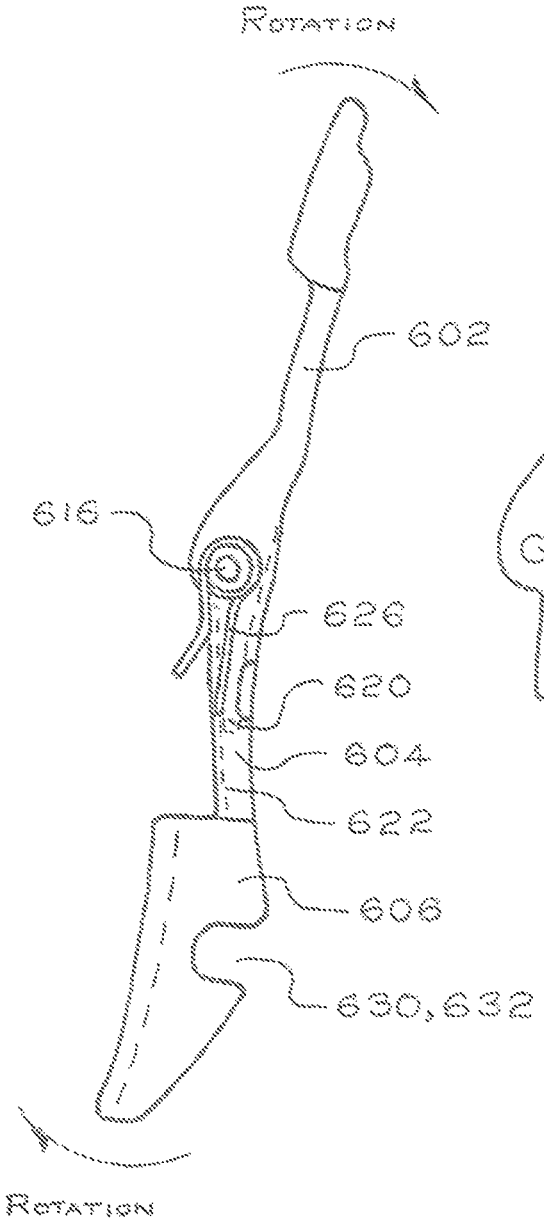
FIG. 6 is a side view drawing of a latch assembly.
Figure 7:
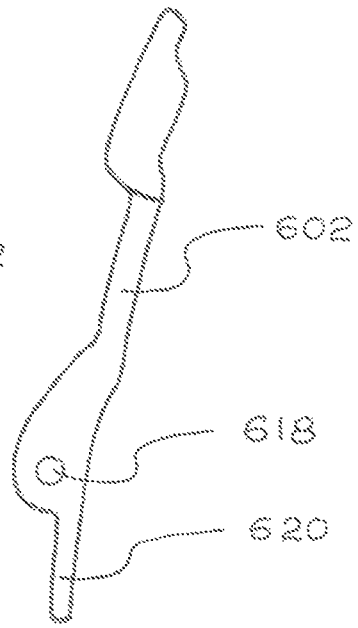
FIG. 7 is a side view drawing of the latch handle, which is part of the latch assembly.
Figure 8:
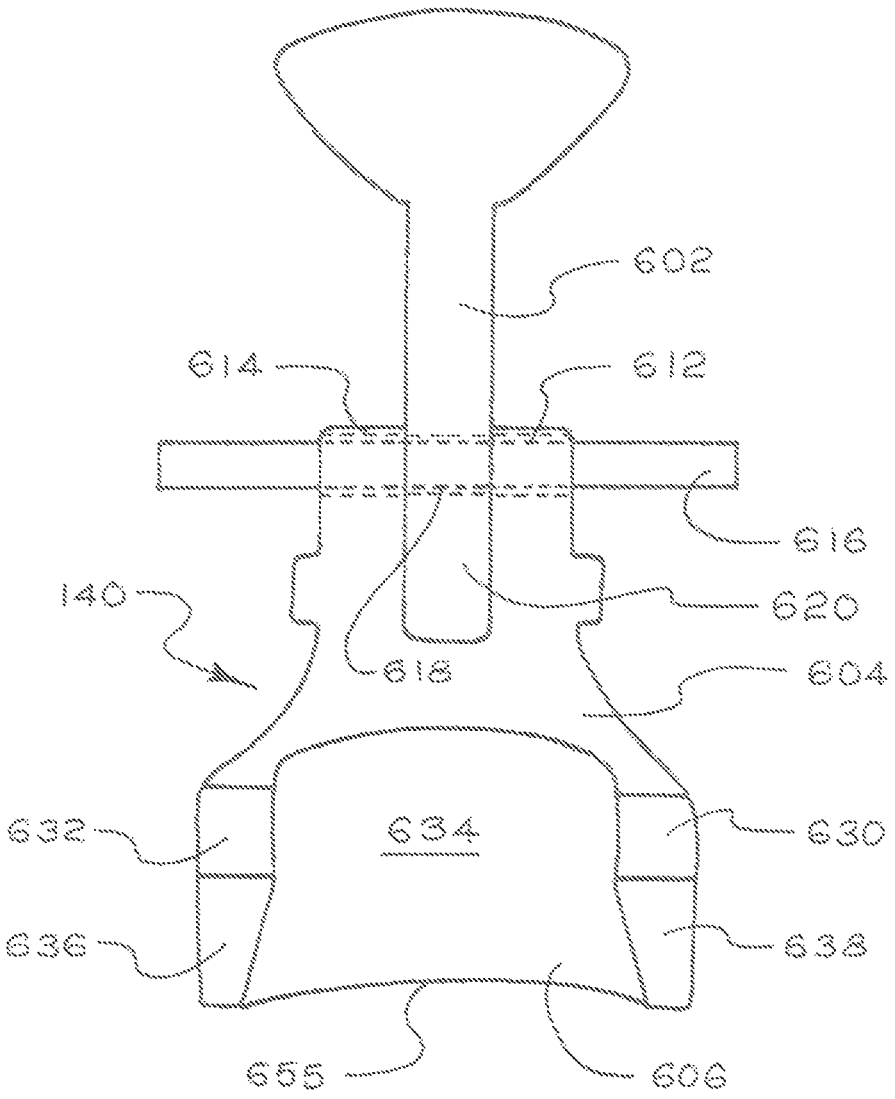
FIG. 8 is a front view drawing of the latch assembly.

Continuing with FIGS. 6, 7 and 8, the latch 600, which is the first portion of the latch system 140, includes a latch handle 602 and a latch portion 606 connected by a mid-section 604. More specifically, the mid-section 604 defines a pair of cooperating bores 612, 614. The latch handle 602 also defines a bore 618. An axle 616 is passed through the bores 612, 614, 618 thereby rotationally connecting the mid-section 604 to the latch handle 602. The latch portion 606 is ridgedly connected to the mid-section 604.

Extending from the latch handle 602 is a tab 620 that abuts a bearing surface 622 in the mid-section 604. When the latch handle 602 is pushed such that the tab 620 interacts with the bearing surface 622, the latch handle pivots about the axle 616 and the tab causes the mid-section 604 to rotate in the same direction, which in turn moves the latch portion 606. It should be appreciated that since both the latch handle 602 and the mid-section 604 pivot about the axle 616, and the two are not ridgedly connected, the latch portion 606 can be rotated about the axle independently of the latch handle.

The latch portion 606 includes cooperating detents 630, 632, a cavity 634 dimensioned to receive a tab 142, 144 located on the backplate 112, and bearing surfaces 636, 638.

Referring to FIG. 3, the latch handle 602 is positioned on the arch 110, one below each handle 114, 116. The latch handle 602 is positioned relative to its respective handle 114, 116 such that the fingers of a hand can depress the latch handle inward (into the opening 106) to release the arch 110 from the backplate 112. More specifically, a hand is placed on a handle 114, 116 such that the thumb is on the inside (the side within the opening 106) and the fingers are extending downward on the other side. The placement of the latch handle 602 should allow the finger tips to touch the latch handle such that fingertips can exert sufficient force to move the latch handle 602.

Figure 9:
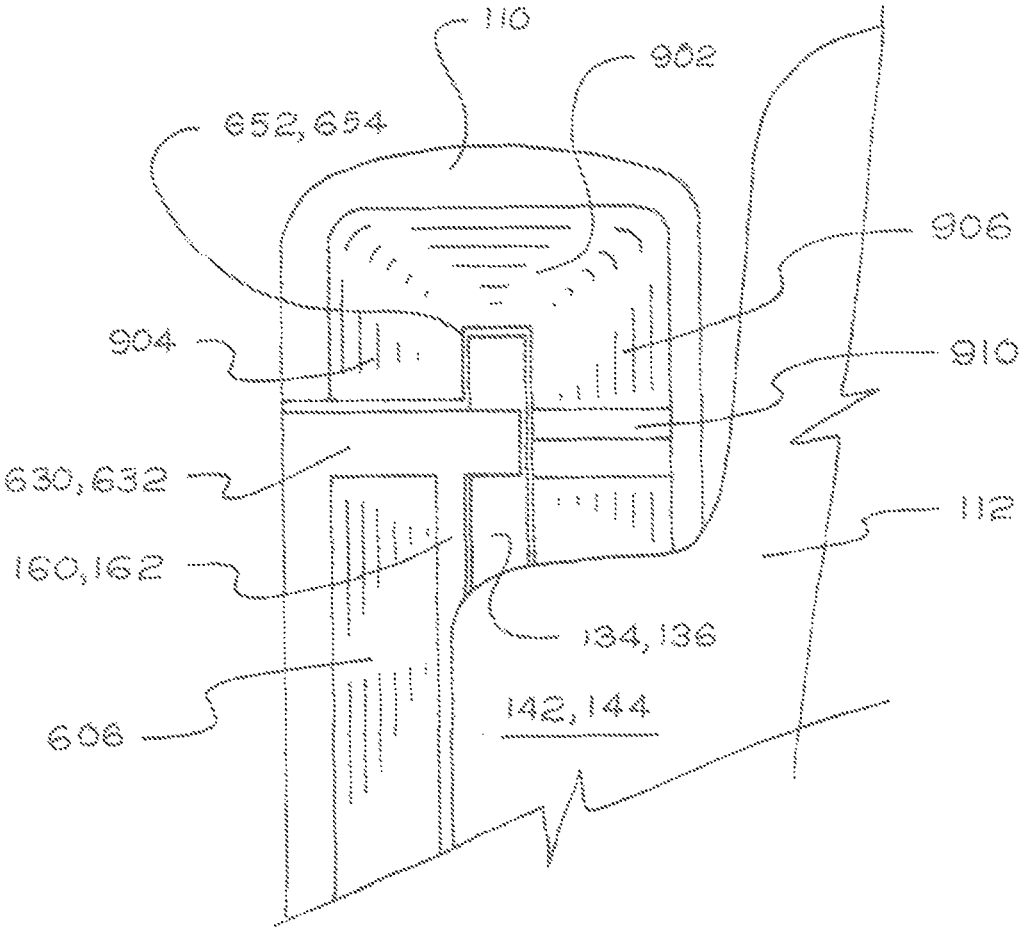
FIG. 9 is a section drawing taken along line 9-9, shown in FIG. 1.

Continuing with FIG. 9, the latch portion 606 is located at the base of the arch 110. The arch 110 defines openings 160, 162 for receiving the portion of the latch system located on the backplate 112.

The latch pins 134, 136 are the second portion of the latch system 140 and are located on the backplate 112. In this illustrative case, the latch pins 134, 136 extend outwardly from both sides of the tabs 142, 144 and are generally parallel one to the other.

Figure 10:
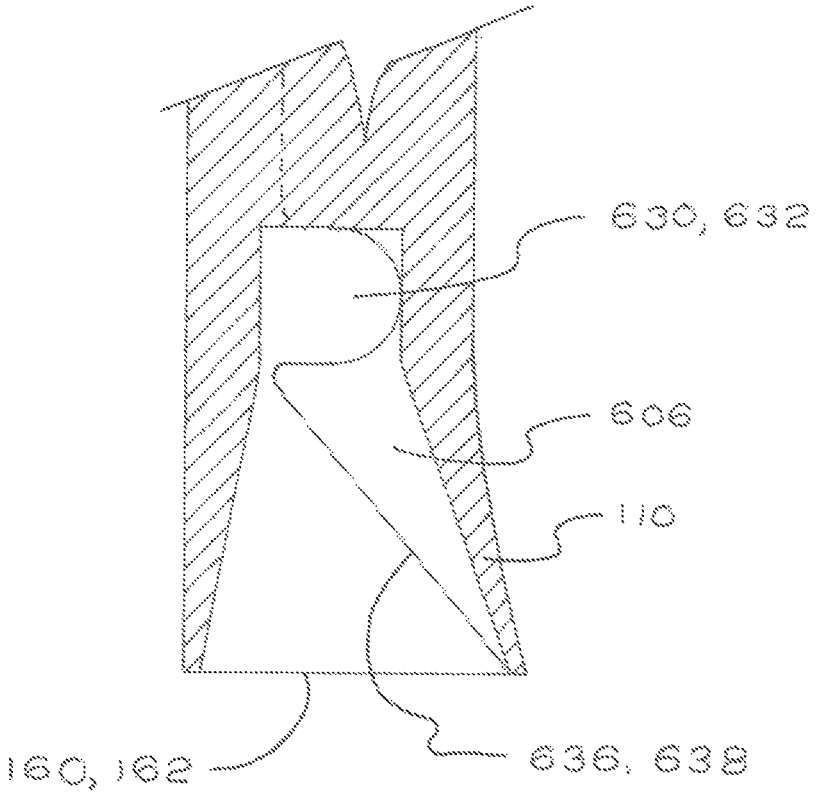
FIG. 10 is a section drawing taken along line 10-10, shown in FIG. 3, with the outer surface removed and the backplate removed.
Figure 11:
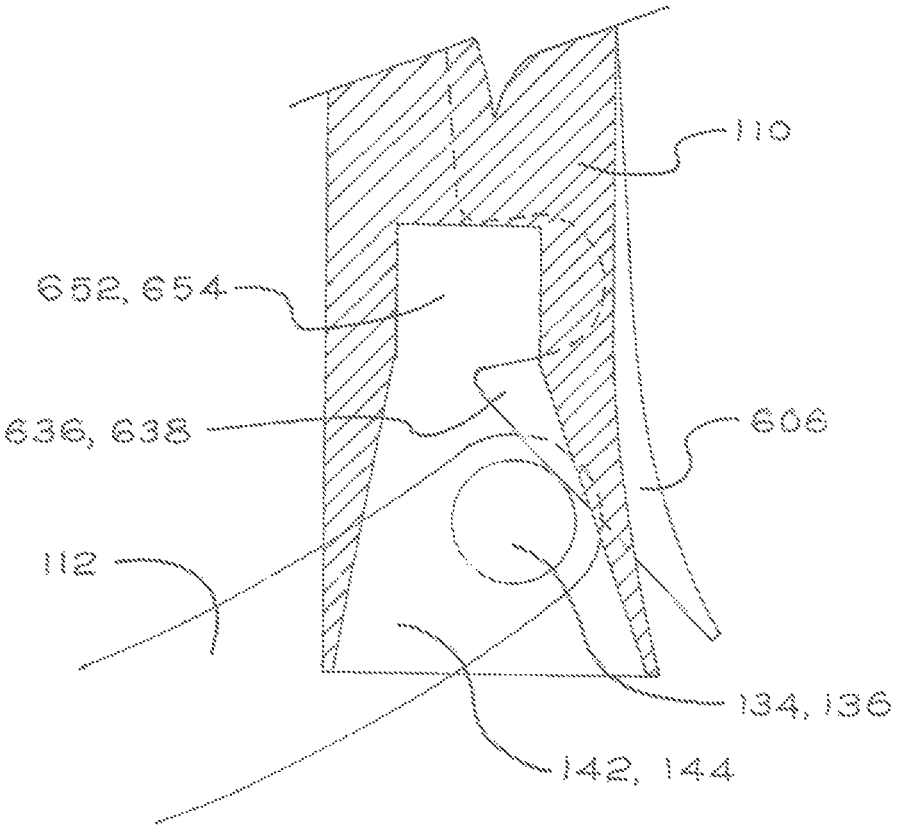
FIG. 11 is a section drawing taken along line 10-10, shown in FIG. 3, with the outer surface removed and the backplate partially inserted.
Figure 12:
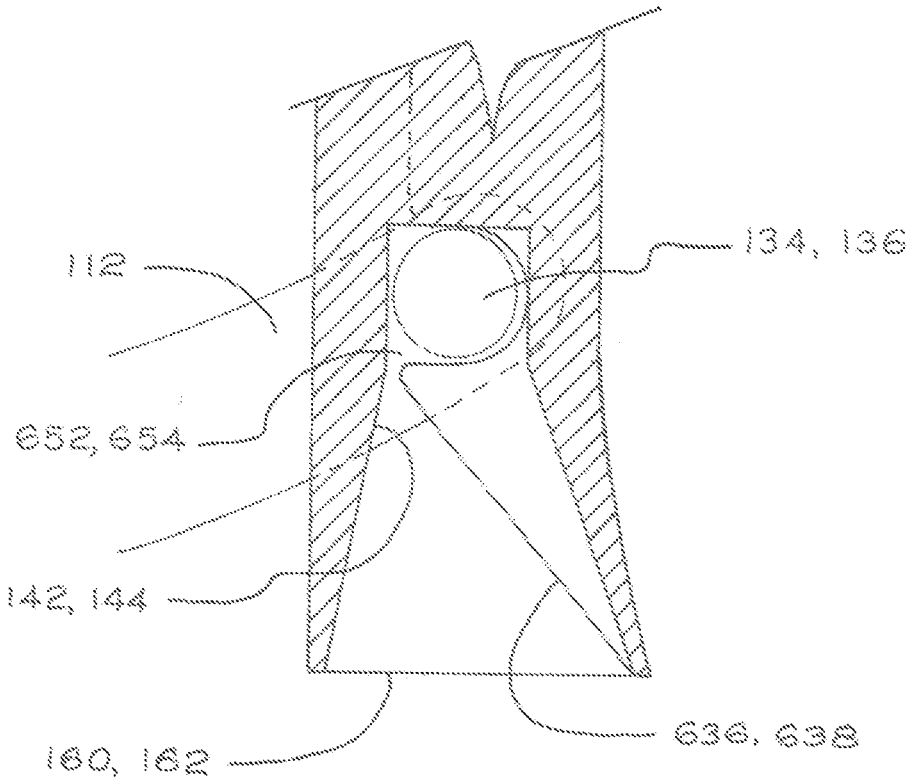
FIG. 12 is a section drawing taken along line 10-10, shown in FIG. 3, with the outer surface removed and the backplate fully inserted.

As shown in FIG. 9, a latch pin 134, 136 enters the opening 160, 162 in the arch 110 and is secured under that latch portion 606. The engagement of the latch portion 606 with a latch pin 134, 136 is illustrated in FIGS. 10, 11, and 12. As shown in FIG. 10, the latch portion 606 is in its normal position without the backplate 112. The latch portion 606 is biased in this position by a spring 626 (see FIG. 6) acting on an abutment 628 projecting outwardly from the mid-section 604. As illustrated in FIGS. 1, 2 and 3, an outside surface 628 of the latch portion 606 defines a portion of the outside surface of the arch 110.

Continuing with FIG. 11, the latch pin 134, 136 engages the latch portion 606 on a contact surface 650. This engagement causes rotation of the latch portion 606 outside the arch 110, clearing an entry way into a seat 652, 654. As shown in FIG. 12, after the latch pin 134, 136 enters the seat 652, 654, the latch portion 606, which has detents 630, 632, secures the latch pin.

The entry from the opening 160, 162 to the seat 652, 654 may be flared and contoured. Flaring controls the precision needed for placing the latch pin 134, 136 within the opening 160, 162. Contouring controls how the latch pin 134, 136 travels once within the opening 160, 162.

It should be appreciated placement of a latch pin 134, 136 into an opening 160, 162 will be a "blind" placement, as a user is placing the opening over a latch pin. As a result, the greater in area the opening 160, 162 is the easier it will be to attach the arch 110 to the backplate 112.

As shown in FIG. 9 in this illustrative example, flaring is provided both longitudinally and laterally within the opening 160, 162. Longitudinal flaring is provided by a first contoured surface 902. Lateral flaring is provided by cooperating second and third contoured surfaces 904, 906. These contoured surfaces define the flare by creating an opening that is larger than the opening that would have otherwise been defined if the surfaces of the seat 652, 654 where extended.

The contouring guides the relevant latch pin 134, 136 within the relevant opening 160, 162 to the relevant seat 652, 654. In this illustrative example, there is sufficient contouring such that as the ends of the latch pin interacts with contouring the tab 142, 144 are prevented from contacting any of the surfaces that define the opening and seat. The contoured surface 910, which does not guide a pin end, is provided to avoid having the tab 142, 144 contact any surface due to the play permitted by the other contoured surfaces. After the latch pin is secured, the tab 142, 144 of the backplate 112 is in the cavity 634 and not touching the latch portion 606.

The contouring of the opening, the contact surfaces 636, 638 of the latch portion 606, and the spring bias applied to the latch portion cooperate to determine the ease by which the latch pins 134, 136 will slide into the seat 652, 654. It is desirable to make the force required to engage the latch pins 134, 136 relatively consistent. A relatively constant force can be achieved by maintaining, or minimizing the change in, the angle of attack of the latch pins 134, 136 on the bearing surface 636, 638. In this case, the bearing surface 636, 638 is given an outward curvature to minimize the change in the angle of attach as the latch pins 134, 136 are inserted.

It should be appreciated that since both the latch portion 606 and latch handle 602 pivot about the axle 616, the latch portion, without displacing the latch handle, can be displaced by grasping a bottom edge 656, 658 of the latch portion. As a result, the latch 600 can be disengaged from the latch pin 134, 136, permitting the backplate 112 to be disconnected from the arch 110, by pulling outwardly on the bottom edge 655 of the latch portion 606. More specifically, pulling on the bottom edge 655 causes the latch portion 606 to rotate about the axle 616. Thus, if the latch handle 602 cannot be rotated inward, such as if the victim's body prevents it, the arch 110 can still be disconnected from the backplate 112.

This latch design permits either latch to be disengaged by pushing the latch handle 602 inward or grasping of the bottom edge 655 and pulling it outward, or one latch to be disengaged as describe above and the other latch to be disengaged by rotation of the arch 110 about the still connected latch pin 134, 136, creating a multi-disengagement latch. A "multi-disengagement latch" as used herein means a latch that has more than one non-destructive mechanism by which it can be disengaged. More specifically, as the arch 110 is rotated about a latch pin 134, 136 the bottom surface of the backplate 112 impacts the bottom edge 655 of the latch forcing it outward causing it to disengage. Disengaging a latch by rotation offers the advantage of easy removal of the arch 110 from the backplate 112 by rotating arch about the victim instead of having to reach over the victim and pick the arch straight up over the victim.

Compression System

The compression system 200 provides the movement necessary for the CPR Device 100 to provide CPR to a victim. As shown in FIG. 1, the compressions system 200 is mounted to the arch 110. The compression system 200 incorporates a drivetrain (generally referred to as 201) having a motor 210, drive 209 and a ram 220. In this illustrative example, drive 209 is a linear drive and more precisely a linear actuator of the ball screw type, due to its low friction characteristics. The drivetrain 201 is mounted to a housing 203, which acts as a foundation.

When the compression system 200 is secured in the arch 110, the CPR pad 204 is positioned such that it will be above and generally centered on the sternum of a victim positioned within the opening 106. As illustrated, the motor 210 is positioned above the arch 110 with the drive 209 and ram going through the bore 207.

Figure 13:
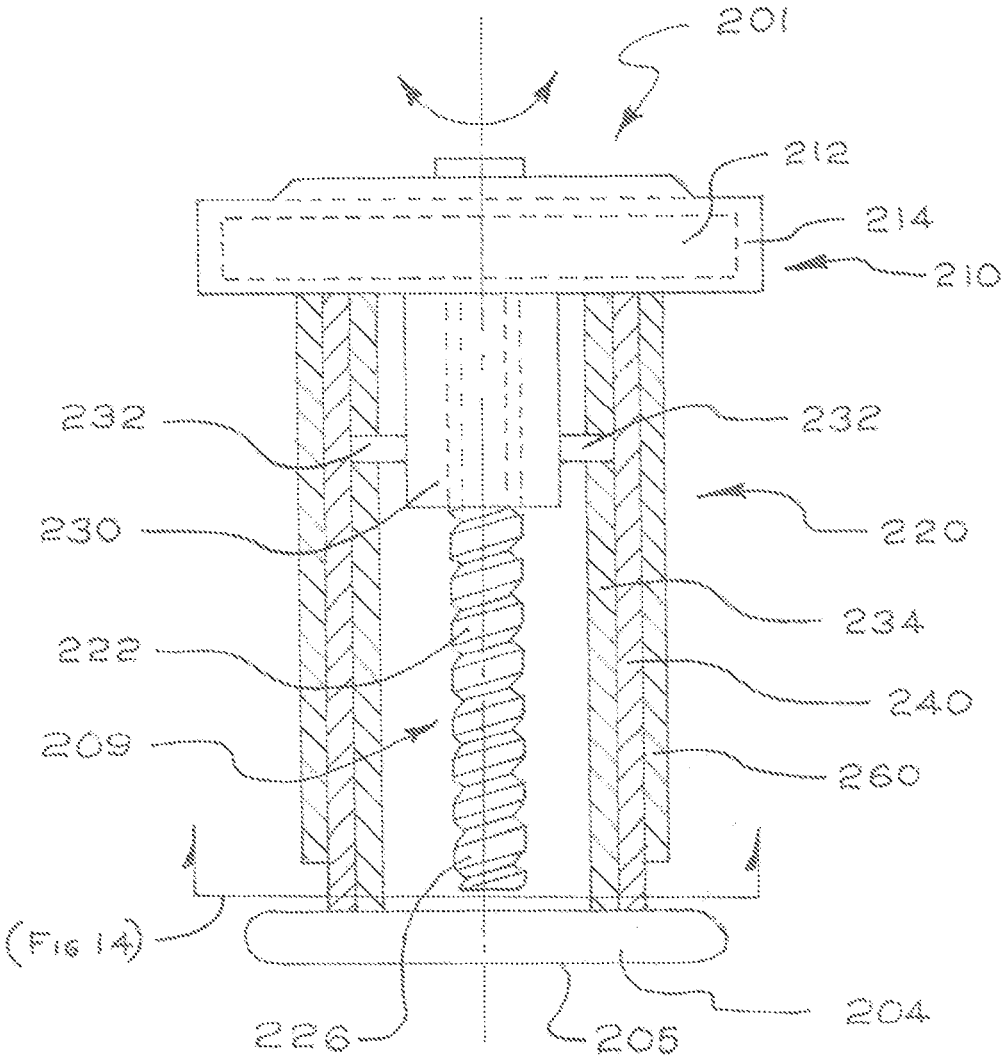
FIG. 13 is a side view drawing with a section removed of the motor.

FIG. 13 is a drawing of an illustrative motor. The illustrated motor 210 is an "out-runner," but other motors could be used. In this style of motor, the rotor 214 rotates outside of the stator 212.

As shown in FIG. 13A, the rotor 214 has a center hub connected by spokes to an outer ring. It is possible to give the spokes a wing shape (e.g., mean camber equal to or greater than 0, twist, and angle of attach), such that the rotor when rotating acts as a fan.

In this illustrative case, the motor is a DC motor; thus, rotational direction of the rotor 214 is controlled by the polarity of the power supplied to the stator 212.

Figure 22:
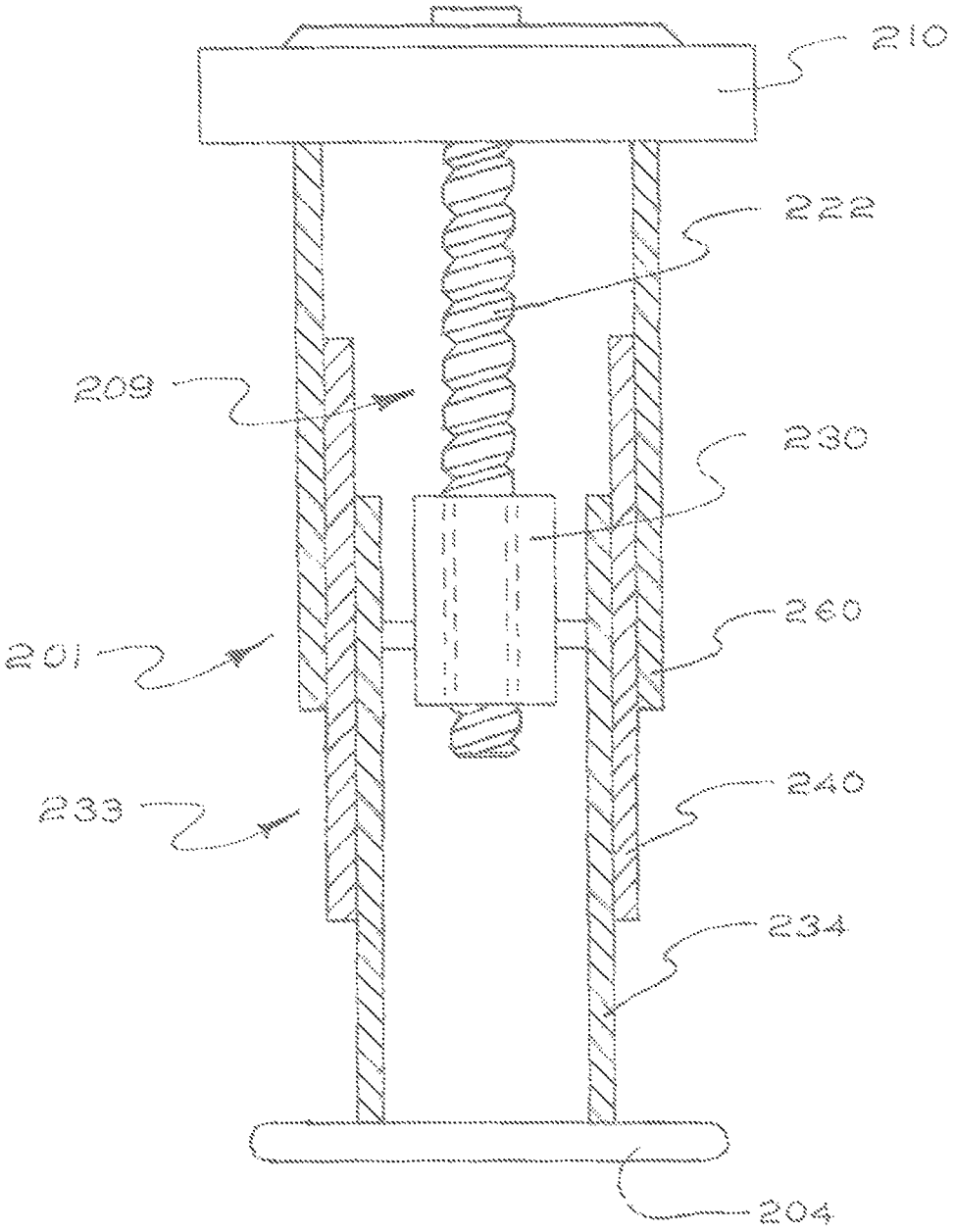
FIG. 22 is a drawing similar to FIGS. 13 and 21 except the inner sleeve has been sufficiently extended to cause the extension of telescoping sleeve.
Figure 23:
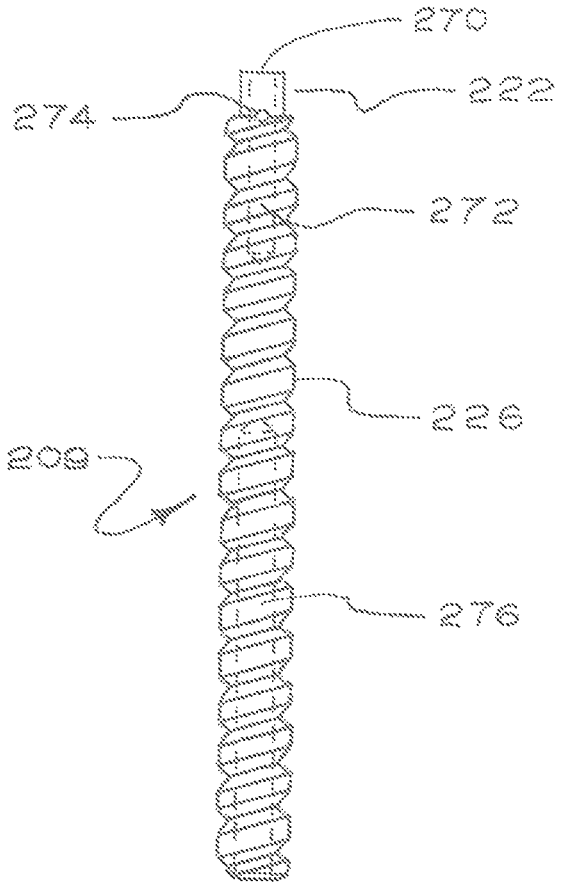
FIG. 23 is a side view drawing of the driveshaft with a section removed to show internal details.

Referring to FIGS. 22 and 23, the drive 209 has a driveshaft 222 that connects to the motor's 210 rotor 214.

Figure 14:
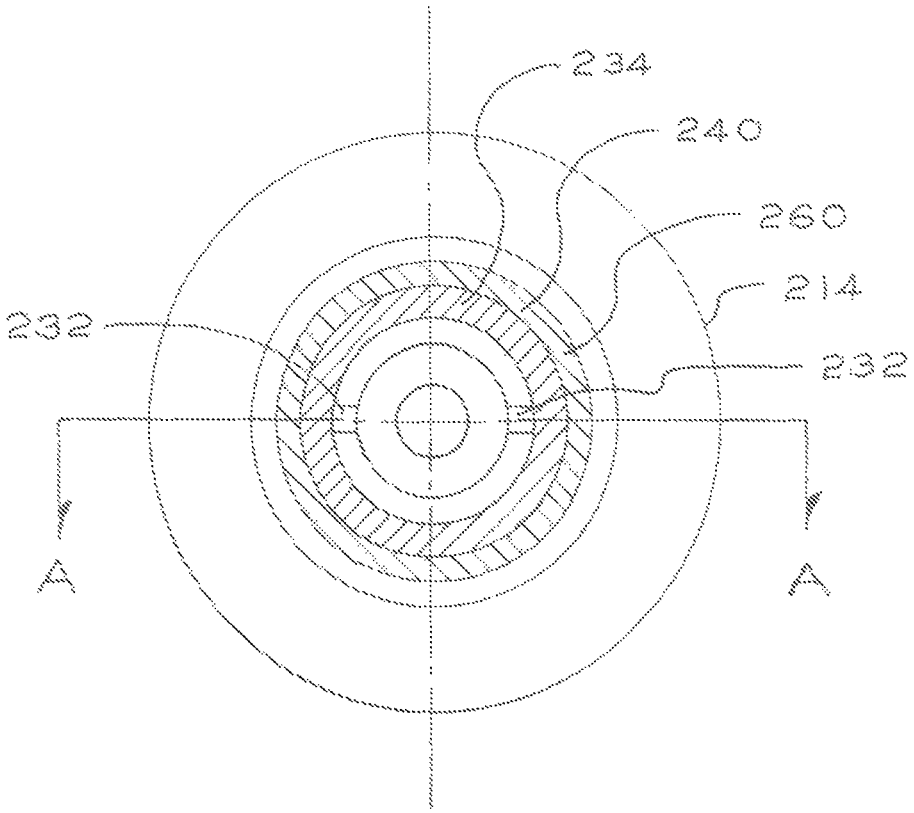
FIG. 14 is a section view drawing of the motor depicted in FIG. 13 taken alone line 14-14, with the section removed in FIG. 13 indicated.

Continuing with FIGS. 13 and 14, the nut 230 rides on the thread portion 226 of the drive 209. The nut 230 is rigidly secured by one or more connectors 232 to an inner sleeve 234 of the ram 220. The connection system is a matter of design choice and may be permanent or allow for non-destructive disconnection. Some suitable connectors are pins, screws, or rivets.

The inner sleeve 234 of the ram 220 has a distal end 205. In this illustrative example, the distal end is define by an outer surface of a CPR pad 204. Thus, as the nut 230 travels along the thread portion 226 of the driveshaft 222, the distal end 205 moves. The distal end 205 completes one stroke by the nut 230 moving down the threaded portion 226 and then being retracted by moving up the threaded portion.

Figure 16:
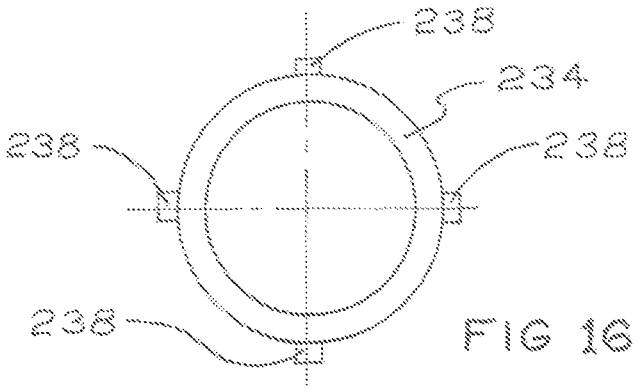
FIG. 16 is a top view drawing of the inner sleeve.
Figure 15:
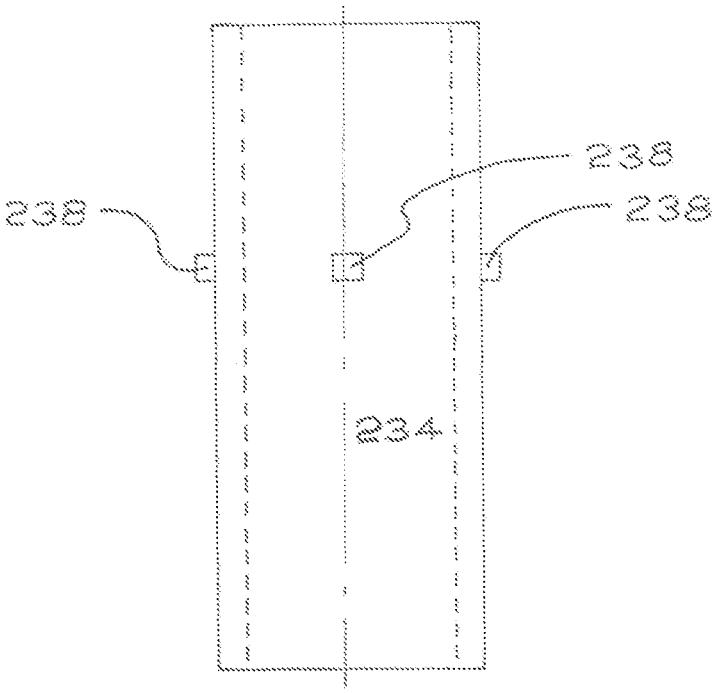
FIG. 15 is a side view drawing of the inner sleeve.

Referring to FIGS. 15 and 16, the inner sleeve 234 has attached to and projecting outwardly therefrom cooperating rollers 238. In this illustrative example, there are four rollers with one positioned at 0, 90, 180, and 270 degrees.

Figure 18:
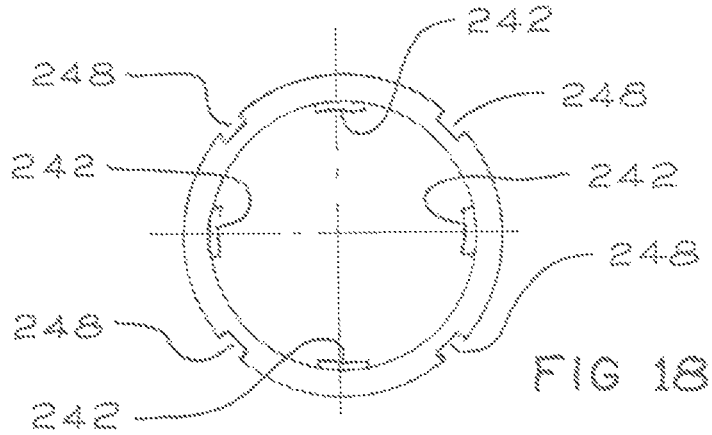
FIG. 18 is a top view drawing of the telescoping sleeve.
Figure 17:
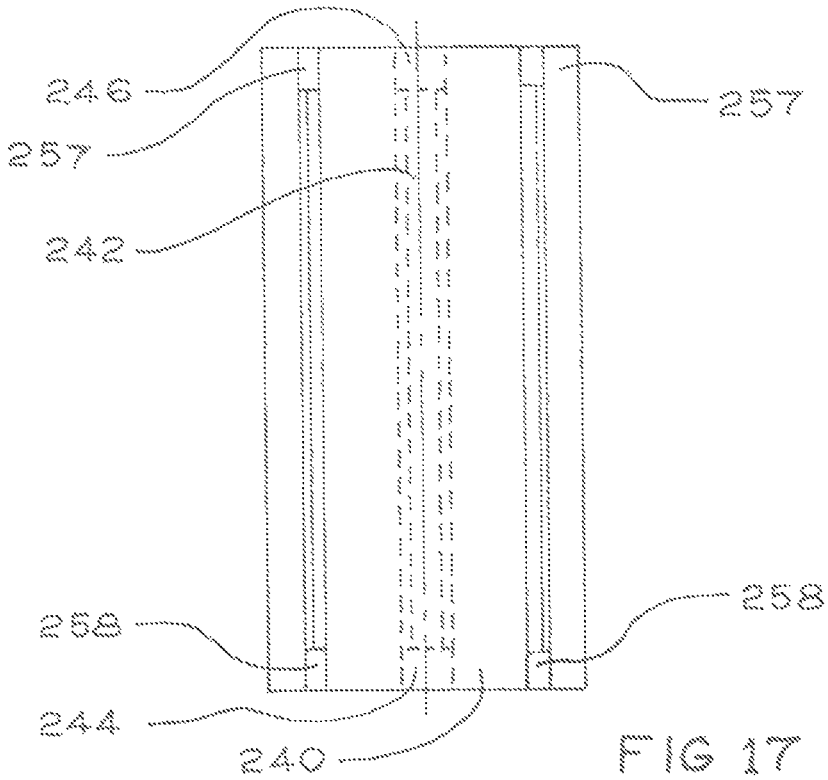
FIG. 17 is a side view drawing of the telescoping sleeve.

Referring to FIGS. 13, 17 and 18, the inner sleeve 234 is positioned within a telescoping sleeve 240. As shown in FIGS. 17 and 18, the telescoping sleeve 240 defines inner channels 242 on the inside. At least one roller 238 on the inner sleeve 234 is placed in the appropriate inner channels 242. In this illustrative example, each roller 238 has an inner channel 242. The rollers 238 should roll in an orientation that allows them to move along the inner channel 242.

Positioned within at least one channel 242 is a bottom stop 244 and within at least one channel, which may be the same channel, an upper stop 246. The function of the stops is discussed below.

The telescoping sleeve 240 of the ram 220 also has at least one outer channel 248. The illustrated outer channels 248 are offset 45 degrees from the inner channels 242. Similarly to the at least one inner channels 242, there are outer upper stop(s) 257 and outer lower stop(s) 258.

Figure 20:
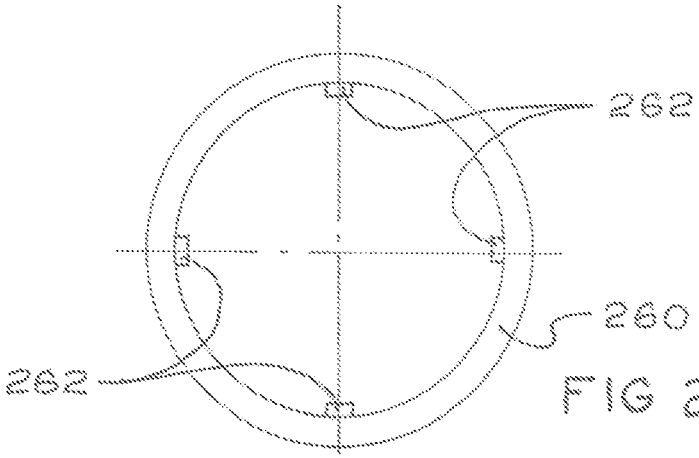
FIG. 20 is a top view drawing of the exterior sleeve.
Figure 19:
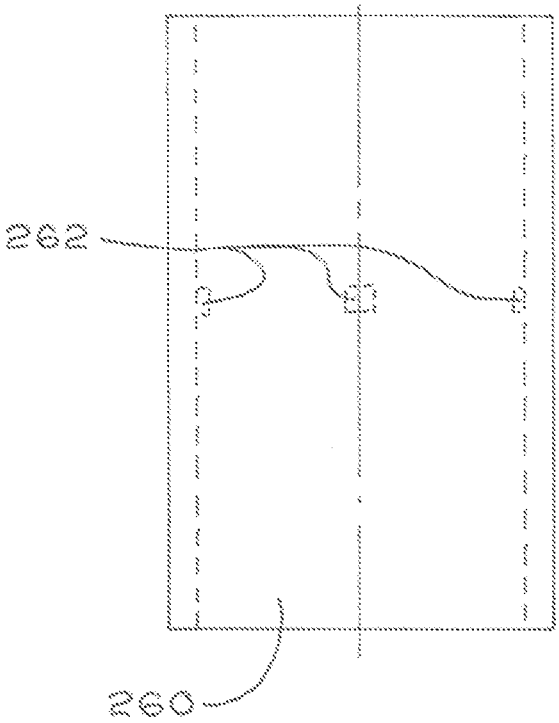
FIG. 19 is a side view drawing of the exterior sleeve.

Referring to FIGS. 13, 19, and 20, the telescoping sleeve 240 is inserted into an outer sleeve 260. As shown in FIG. 19, the outer sleeve 260 has at least one inwardly projecting tab 262. The tab(s) 262 are inserted in respective outer channels 248 of the telescoping sleeve 240.

It should be appreciated by those skilled in the art, that the structure for the telescoping sleeve 240 could be repeated such that there is more than one telescoping sleeve.

Any rotation of the inner sleeve 234 is not desirable. In the illustrated example, a torque transfer system from the nut 230 to the outer sleeve 260 is provided by the linkage system from the nut to the inner sleeve 234, from the inner sleeve to the telescoping sleeve 240, and from the telescoping sleeve to the outer sleeve 256. More precisely, the connectors 232 and the edges of the inner and outer channels 264, 266 interacting respectively with the sides of the rollers 236 and the tabs 246.

Figure 21:
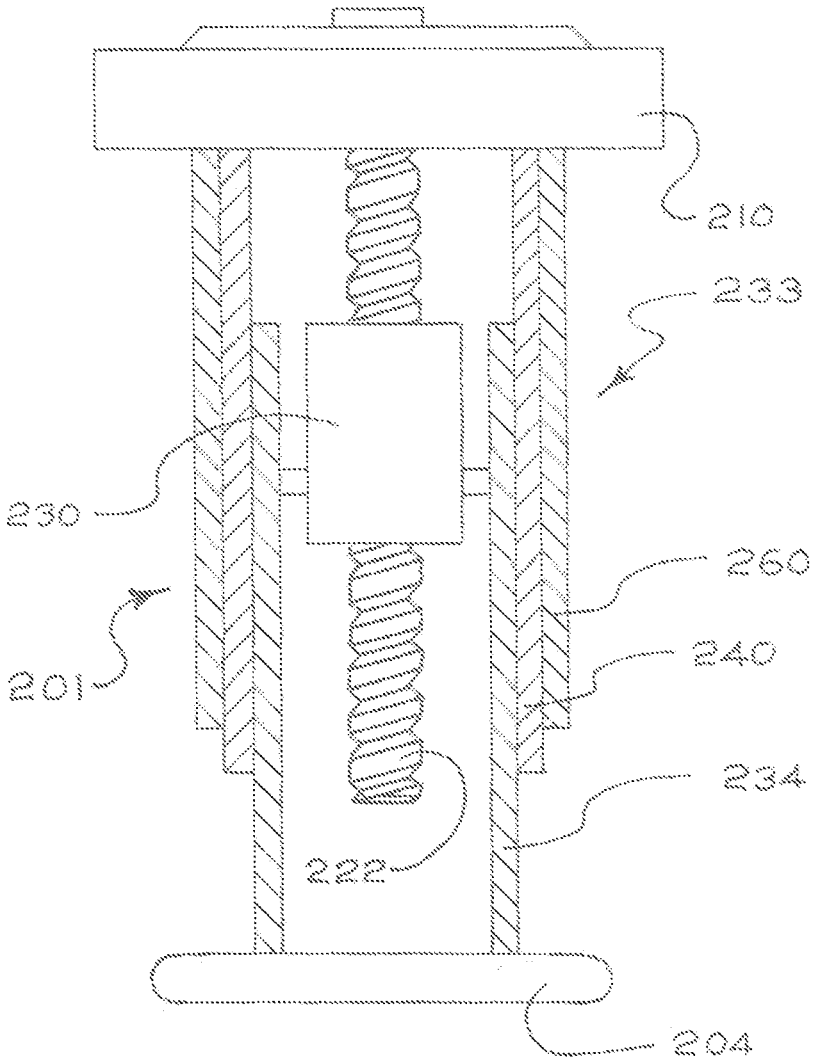
FIG. 21 is a drawing similar to FIG. 13 except the inner sleeve is extended.

FIGS. 13, 21, and 22 depicts the interaction of the various sleeves—inner sleeve 234, telescoping sleeve 240, and outer sleeve 260—of the ram 220. In FIG. 13, the inner sleeve 234 is not extended. In FIG. 21, the inner sleeve 234 has been extended but not sufficiently enough to cause a roller 238 on the inner sleeve 234 to impact a bottom stop 244 on the telescoping sleeve 240. As a result, the telescoping sleeve 240 remains in position due to the friction created by tabs 262 on the outer sleeve 260 within outer channel 248. In FIG. 21, the inner sleeve 234 has been extended sufficiently to cause a roller 238 to impact a bottom stop 244 and providing sufficient energy to overcome the friction created by the tabs 262 thereby extending the telescoping sleeve 240. This procedure when reversed (upper stop 246 instead of bottom stop 244) will cause the telescoping sleeve 240 to retract.

It should be appreciated that the telescoping sleeve 240 permits the nut 230 to act as a lower bearing for the driveshaft 222. As a result, an intermediate bearing between an upper bearing and a lower bearing is avoided. For the nut 230 to be an effective lower bearing the overlap of the telescoping sleeve 240 relative to the inner sleeve 234 and the outer sleeve 260 must be sufficiently ridged. An overlap of 4 to 1 (length remaining with a sleeve to extension) is suitable.

It is desirable that the diameter of the telescoping sleeve 240 not exceed the diameter of the CPR pad 204, such that the telescoping sleeve is concealed above the CPR pad. It, also, should be appreciated that while the various sleeves have been described is cylindrical terms, this is not a requirement of the invention, and the use of cylindrical terms herein should not be considered limiting unless expressly stated as limiting.

Continuing with FIG. 23, the driveshaft 222 has an orifice 270 leading to an oil sump 272. Above the bottom of the oil sump 272, is a passage 274 to permit oil to exit the oil sump and lubricate the thread portion 226. The passage 274 is placed below the motor but above the upper most position of the nut 230. Oil is put into the oil sump 272 through the orifice 270. The driveshaft 222 also is lightened by a centerline bore 276.

In this illustrative example, the compression system 200 is removable from the arch 110. More precisely, at least a portion of the housing 203 of the compression system 200 is inserted in the arch 110 in a through bore defined by the arch and held therein by a first mount (generally referred to by reference number 280). As shown in FIGS. 24, 25, 26, and 27, the first mount is of the quick-disconnect style, a quarter-turn type, that includes an insert 282, FIGS. 24 and 25, integrated into the compression system 200 that engages a lock 284, FIGS. 26 and 27, that is integrated into the arch 110.

Figure 25:
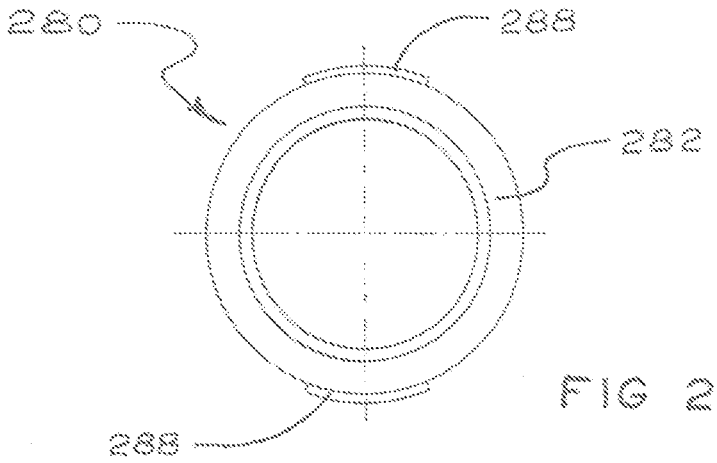
FIG. 25 is a top view drawing of the insert.
Figure 24:
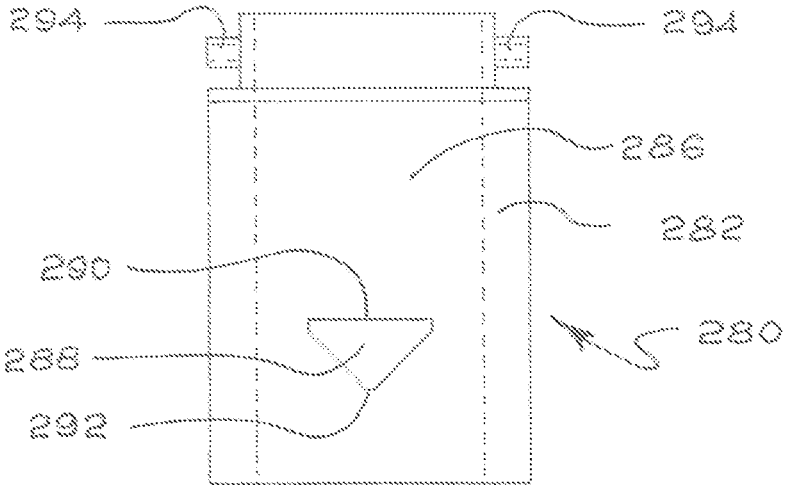
FIG. 24 is a side view drawing of the insert.

Continuing with FIGS. 24 and 25, the insert 282 defines a thru-bore 286 through which the ram 220 is positioned. More precisely, the outer sleeve 256 of the ram 220 is placed in the thru-bore such that the motor is on one side of the insert 282 and the CPR pad 204 is on the other. The outer sleeve 256 of the ram 220 is secured to the insert 282. In this illustrative case, it is permanently connected (i.e., destructive disconnection), but it could be by temporary fasteners, such as screws, which would allow non-destructive removal.

Positioned on the outer surface of the insert 282 is a pair of keys 288. The keys 288 are generally triangular having a base 290 and apex 292, which points in the direction of the CPR pad 204.

The insert also includes a pair of bosses 294 that provide the connection between the insert 282 and a housing 203 (see FIG. 1).

Figure 27:
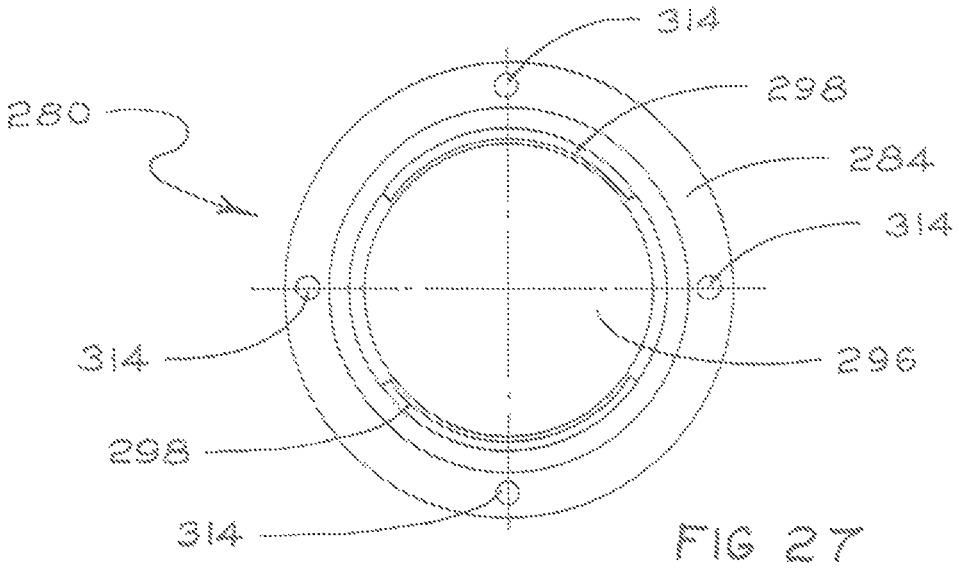
FIG. 27 is the top view drawing of the first mount.
Figure 26:
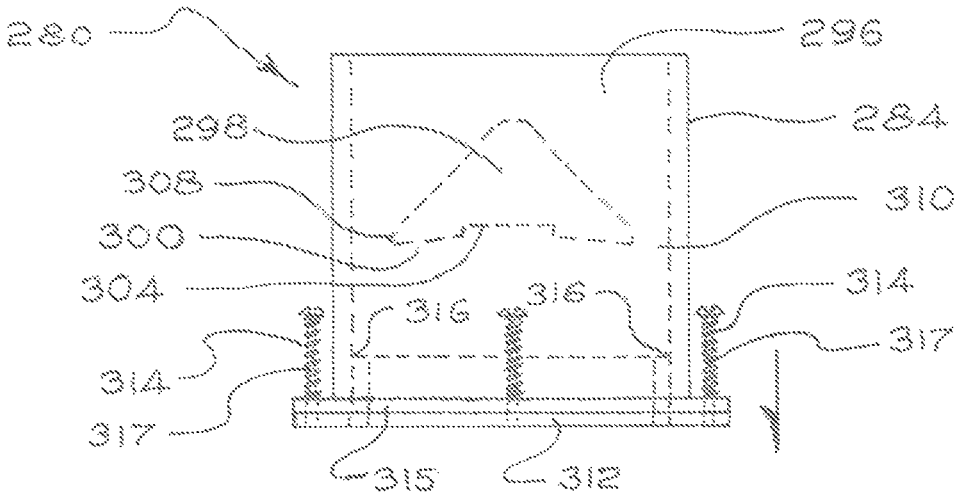
FIG. 26 is a side view drawing of a first mount.

Continuing with FIGS. 26 and 27, the insert 282 is dimensioned to slide into a bore 296 defined by the lock 284. On the surface of the bore 296, is a pair of keepers 298. The keepers 298 are generally triangular with the apex pointing at the opening in the bore 296 through which the insert 282 will be inserted. The keepers 298 are positioned such that they are not touching; thus defining a number of gaps equal to the number of keepers. Each gap should be only slightly larger (i.e., just wide enough to let the key slip between the keepers) than a key 288, as it is desirable to have a key impact a keeper 298 upon insertion of the insert 282 into the housing 203.

The base 300 of the keepers 298 define a notch 304 dimensioned to accept the base 290 of the key 288. The base 290 on either side of the notch 304 is curved toward the apex, such that the base vertices 308, 310 are "below" the notch entrance.

At the base of the thru-bore 286 is a flange 315 that interacts with a bias plate 312. More specifically, the bias plate is secured by a pin 317 running through each at least on spring 314. The pin 317 passes through the flange 315 and connects to the bias plate 312, which effectively traps the at least one spring 314 between the top of the pin and the flange.

The bias plate 312 has an inner surface 316 within the thru-bore 286, which is dimensioned to be impacted by the insert 282 when it is inserted. Prior to the insert 282 impacting the inner surface 316, the at least one spring 314 is in compression causing the bias plate 312 to be held firmly in place against the bottom of the flange 315 on the lock 284. When impacted by the inner surface 316, the pin 317 by movement of the bias plate, to which the pin is connected, acts to put the at least one spring 314 in further compression.

Upon insertion of the insert 282 into the lock 284, the keys 288 will impact a keeper 298; assuming placement does not put them in a gap. Upon impacting the keeper 298, the insert will rotate (in this design rotation can be either clockwise or counter-clockwise) as the apex of the key slides down an edge of a keeper. As the apex of the key 288 passes a base vertex of a keeper 298, insertion of and rotation of the insert continues until the base 290 of the key passes a base vertex of the keeper; thus causing the further compression of the at least one spring 314 to be released thereby self-locking the compression system 200 to the arch 110.

At some point during the insertion of the insert 282 before the base 290 of the key 288 passes a base vertex of the keeper 298, the bottom edge of the insert will impact the bias plate 312 causing the at least one spring 314 to extend. At the point where the key 288 passes a base vertex 308, 310, and with continued rotation of the insert 282, the bias plate 312 will begin to force the key to maintain contact with the keeper 298 until such point that the upper base 290 of the key is securely within the notch 304. To disengage, the procedure is performed in reverse beginning with pushing the insert 282 toward the bias plate 312 to cause the key 288 to disengage from the keeper 298.

Referring to FIG. 2, insertion of the compression system 200 into the arch 110 may be accomplished using second handles 320 positioned on the housing 203.

It should be appreciated that in operation compressive force exerted by the downward movement of the CPR pad 204 will cause the support assembly 102 to flex. Referring to FIG. 1, the opening 106 will be distended by the movement of the top portion of the arch 110 away from the backplate 112. As a result, the support assembly 102 should have sufficient structural integrity to limit this distention, for example to no more than about $3/8^{ths}$ of an inch during a CPR stroke.

Control System

Figure 28:
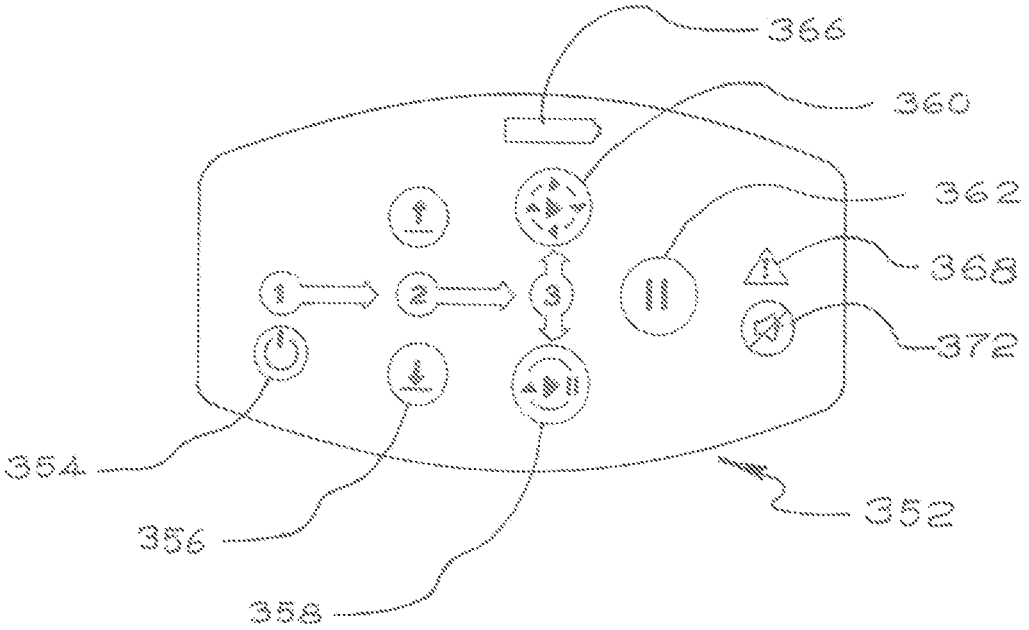
FIG. 28 is drawing of a user interface.

Continuing with FIG. 28, a user interacts with the compression system 200 using a control system 350. The control system 350 is a micro-processor having programming running thereon interacted with by a user through a control panel 352.

The illustrative control panel 352 includes control over the functions of on/off switch 354, CPR pad adjustment control 356, CPR start switch 358, CPR stop switch 360, and CPR pause 362. Also, control panel 352 includes an on/off control over an audio system 372, and a battery status indicator 366.

To operate the compression system 200, a user turns ON the control system 350 by changing the status of the on/off switch 354. When the control system 350 is turned ON, the control system may locate the CPR pad 204 in a known position or obtain the position, referred to as an initial position. The initial position permits the control system 350 to achieve the desired depth of compression.

At this time, a system self-test might also occur, or the results of a self-test conducted while in the OFF state might be reported. In the case of a self-test occurring upon startup, or a previously conducted self-test, such as one conducted in the OFF state, the results are indicated using perceptible, visual, tactile, or audible, output. In this illustrative example, a visual output 368 (e.g. light) is used, which illuminates if the compression system is not functioning properly. The system could also function in reverse with the visual output illuminating if the compression system was functioning properly. In addition, there could be a distinct illumination for either operational condition.

The compression system 200 next places the distal end 205 of the CPR pad 204 into a therapeutic position. The therapeutic position is defined as a start position from which CPR can be effectively delivered (i.e., sufficiently compress the sternum). The spatial difference between the initial position and the start position is the offset.

The start position places the distal end 205 into firm contact with the victim's chest. One method to accomplish this placement is to direct the motor 210 to place the distal end 205 of the CPR pad 204 into contact with the chest such that a pressure between about 11 to 13 kg, with about 12.25 kg being a reasonable amount, is exerted on the chest. Then, put the drivetrain 201 in neutral permitting that distal end 205 to freely change position. In the neutral position, the compressed chest pushes back against the distal end 205 causing the distal end to be retracted (i.e., displaced toward the initial position) until the chest and compression system 220 are in equilibrium. The point at which the distal end 205 comes to rest is the start position. It should be appreciated that to assure that the start position is in firm contact of the distal end 205 with the chest (compress the skin but not the sternum), a minor displacement in the equilibrium position, thus the start position, toward the chest could be made, which would generate minor, but insignificant, pressure on the chest.

The control system 350 may automatically detect the start position employing a proportional integral controller (PI controller). In an illustrative example, the PI controller monitors the speed of decent of the CPR pad 204 from the initial position toward the start position. During decent, an initial voltage applied to the motor 210 is a fraction of that needed to administer CPR. While a matter of design choice, the initial voltage must be less than a voltage need to perform CPR, a maximum voltage of around 50% is acceptable, but greater than zero, voltage around 10-17% is a practical minimum. When the CPR pad 204 initially contacts a chest, the resistance of the chest will cause the speed of decent of the CPR pad 204 to slow, or stop if at maximum voltage. In the event the maximum voltage is not being applied to the motor 210 at initial contact, the voltage applied to the motor is increased (i.e., to a voltage proportional to the error in the PI) in an attempt to cause the CPR pad 204 decent to continue. When the maximum voltage is reached and the decent does not continue, the CPR pad 204 is considered in the start position.

It should be appreciated that a similar procedure could be used to position the CPR pad 204 is any position where the position is determined by resistance, such as the home position.

The CPR pad adjustment controls 356 permit the CPR pad 204 (see FIG. 13), to adjusted both toward and away from a victim's chest, to manually adjust the start position.

Once the CPR pad 204 is in the start position, CPR compressions can begin. CPR compressions are initiated by a CPR start switch 358. CPR compressions are terminated by a CPR stop switch 360. When the CPR stop switch 360 is depressed, the CPR pad 204 is repositioned to a stored position, which could be the initial position.

CPR compressions can also be paused by changing the status of a CPR pause button 364. When CPR compressions are paused, the CPR pad 204 remains in a position suitable to continue CPR compressions when the pause is terminated. More specifically, the CPR pad could be somewhere in the current CPR stoke, or automatically repositioned back to the current start position. It could also be possible to automatically relocate the CPR pad back to some other position as long as the current start position is remember such that when the pause is released the CPR pad automatically returns to suitable position to resume compressions.

The control system 350 may permit control over the depth of the compressions. For example, as the offset (the distance between the initial position and the start position) is increased the depth of compression may decrease. The recommended compression depth is 5 cm, but there is an inverse relationship between the offset and the victim size.

More precisely, as the offset increases the victim is getting smaller (i.e., the victim's cross-section in the thoracic region is decreasing). As a result, the standard compressive depth of 5 cm could be too great.

There are numerous ways in variable compression depth could be implemented. It could be automatic, such that extension determines compression depth. Alternatively, there could be user adjustment, such as through the control panel 352. The system could also be user activated or deactivated, for example by a button (not shown) on the control panel 352.

A battery meter 370 is also provided. The battery meter 370 provides a visual indication of the charge status of the battery.

Programming in the CPR control system 350, may include audio assistance in using the device. The on/off switch 372 controls output of the audio assistance through a speaker (not shown).

The CPR control system 350 may also include a visual status indicator 368, in this illustrative case a light, to indicate the operational status, functioning and/or malfunctioning, of the device. A speaker if available could also be used (e.g., a chirp in the event of a malfunction). The status could be obtained from self-tests, either performed automatically when the CPR unit is OFF, upon startup, or upon user direction.

Power System

Figure 29:
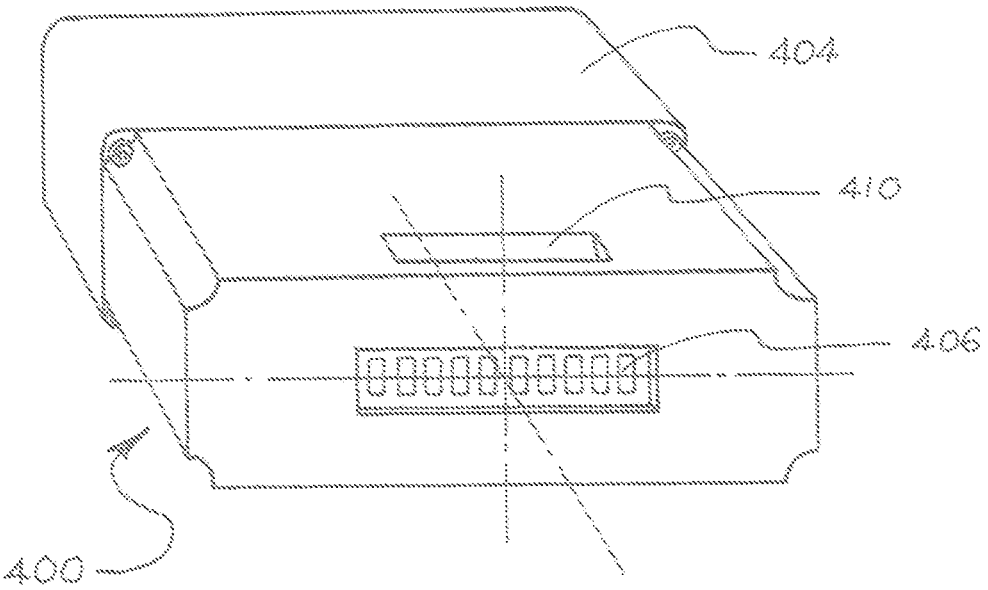
FIG. 29 is a perspective side view drawing of a power system.
Figure 30:
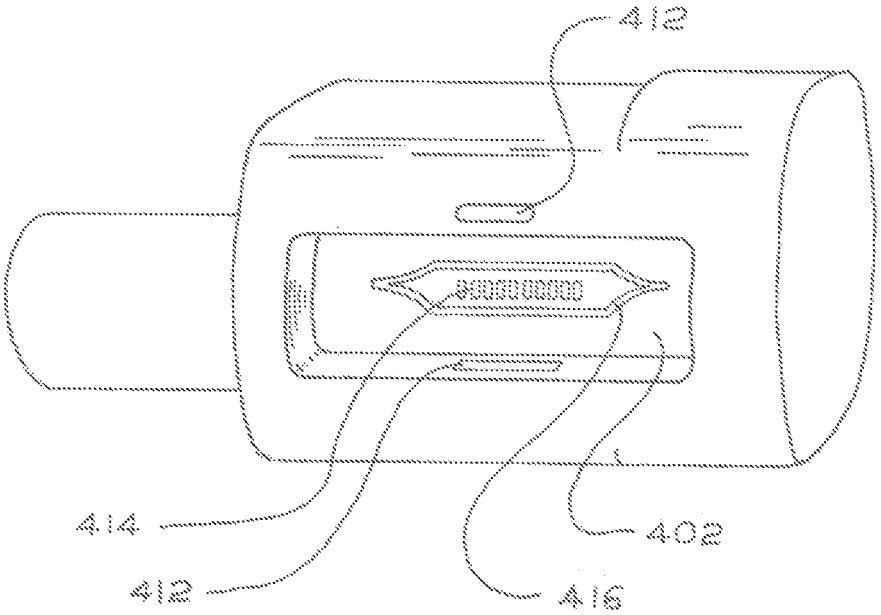
FIG. 30 is a perspective view drawing of the power system slot in the compression system with the power system removed.
Figure 31:
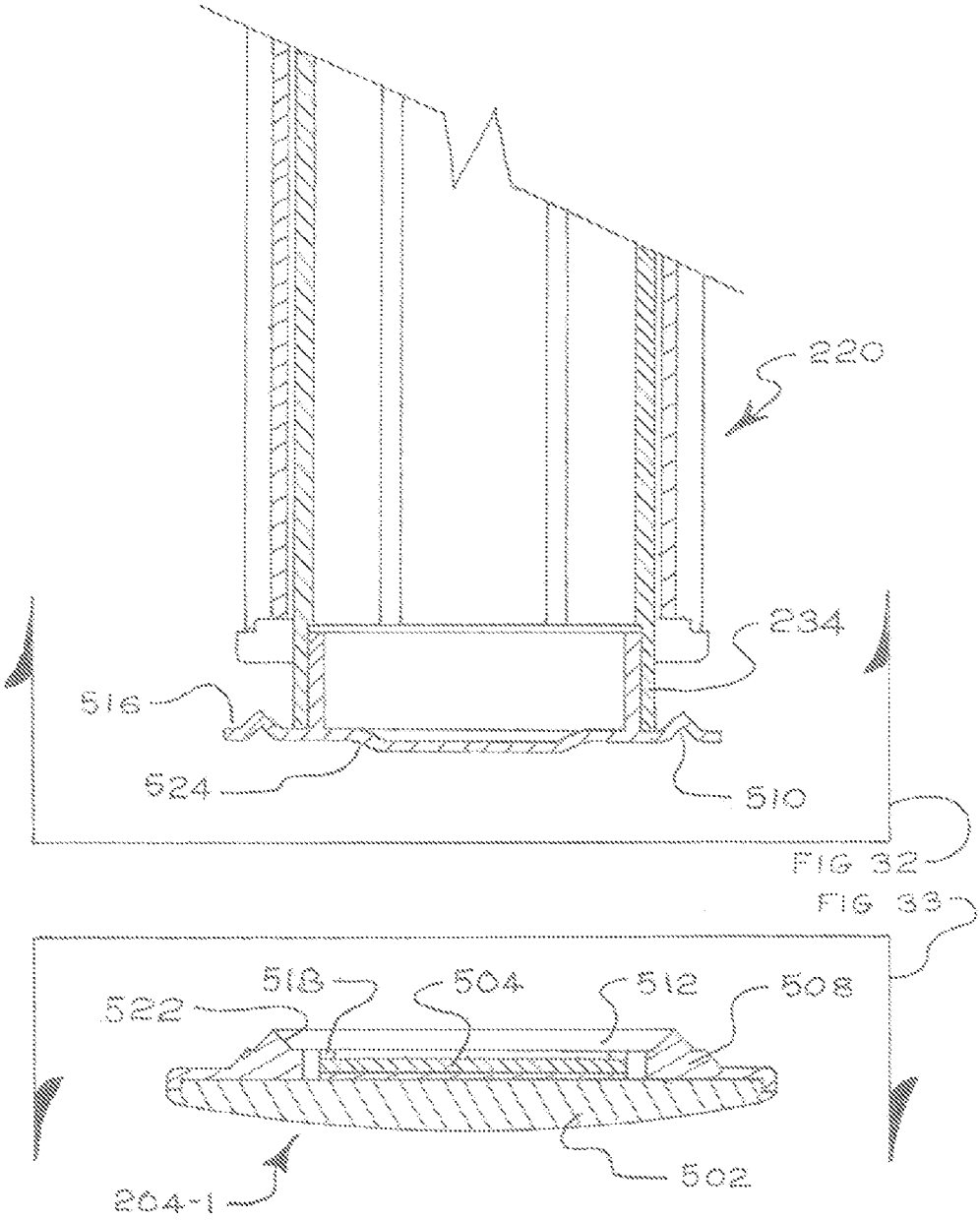
FIG. 31 is a cut away side view drawing of a first embodiment of a CRP pad ready to be mounted on the ram.
Figure 32:
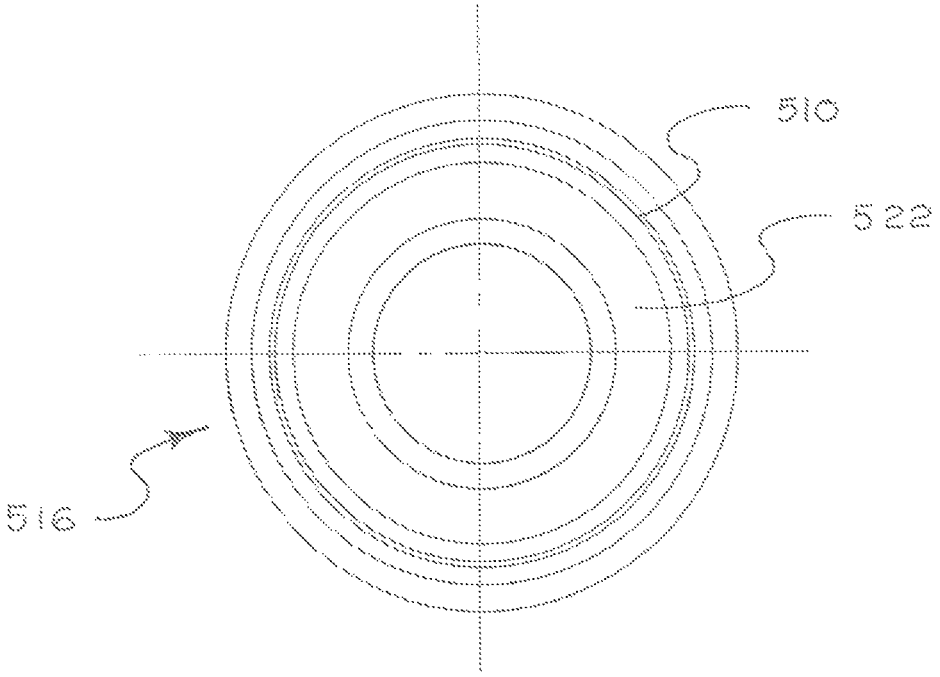
FIG. 32 is a bottom view of the flange shown in FIG. 31 taken along line 32-32.
Figure 33:
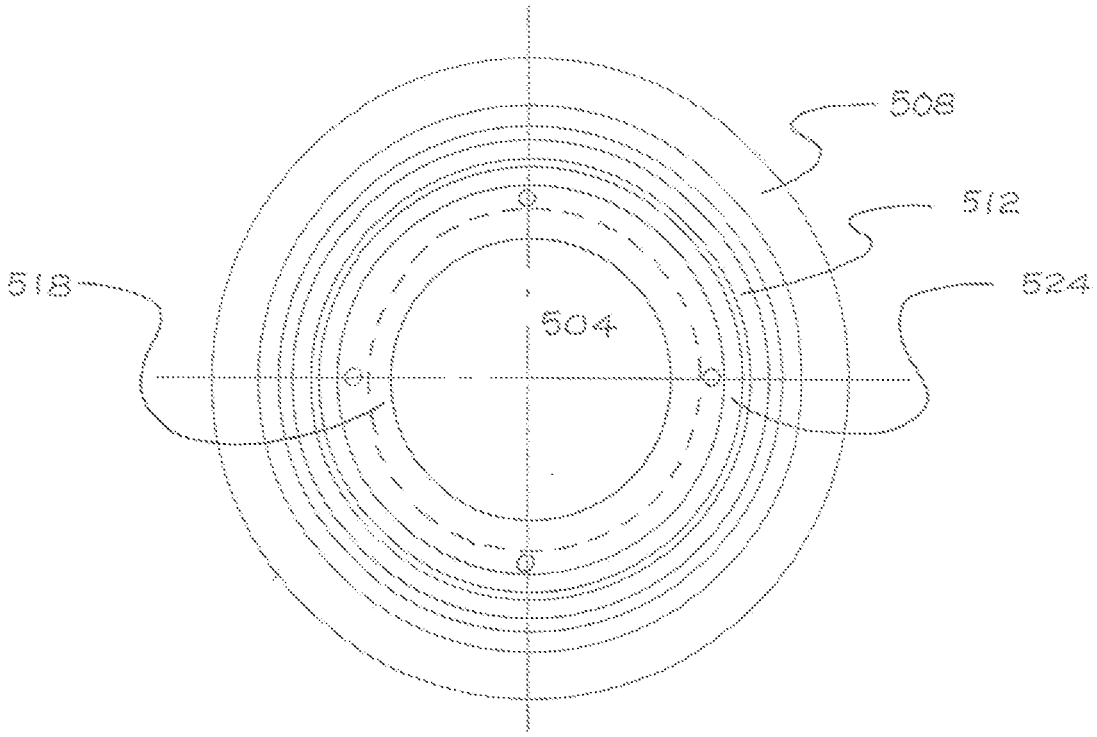
FIG. 33 is a top view drawing of the CPR pad shown in FIG. 31 taken along line 33-33.
Figure 34:
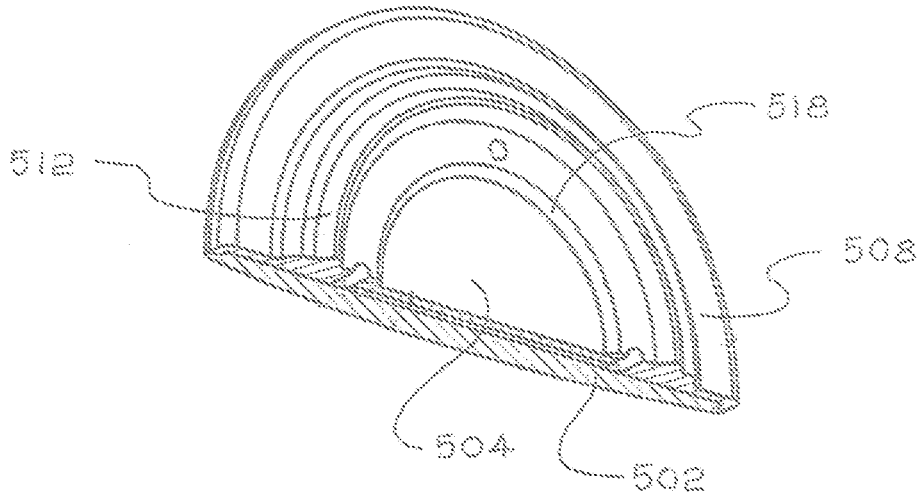
FIG. 34 is a cut away perspective view drawing of the first embodiment of the CPR pad.

Referring to FIGS. 29 and 30, the compression system 200 and control system 350 are powered by a power system power system 400, as illustrated a battery pack that which inserts into a power system slot 402. The power system 400 has a certain number of cells, individual or unified multi-cell, based on the capacity needed, which cells may be rechargeable.

Continuing with FIG. 29, the power system 400 has an outer case 404 that is dimensioned to fit into the power system slot 402. As shown in FIG. 1, only a portion of the outer case 404 fits within the power system slot 402 with the balance creating a gripping portion.

The power system 400 further has one-half of an electrical connector 406, comprised of a series of individual connectors 408, located on the bottom. The electrical connector 406 is symmetrical about the centerline lines of the power system 400. In addition, the power system 400 has tabs 410 (one on each side), symmetrically located about a centerline, which is shared with the electrical connector 406.

As shown in FIG. 30, latches 412, which are spring biased, generally simultaneously engage tabs 410 to secure the power system 400 in the power system slot 402. The power system slot 402 also has complementary connector 414 to the electrical connector 406 on the power system 400. A spring 416 is also provided. By insertion of the power system 400 in the power system slot 402, the spring 416 is compressed permitting the spring to assist in battery removal when the latches 412 are released.

The symmetry of the outer case 404, the latches 412, the electrical connector 406 and the complementary connector 414 permits the power system 400 to be inserted in the power system slot 402 in more than one orientation, two in this illustrative example.

Optionally, power can be provided by a line voltage source.

Accessories

As discussed above, the CPR Device 100 may have a CPR pad 204. Where it is intended that the outer surface of the CPR pad 204 touch a victim, the CPR pad should be replaceable. Temporary attachment could be by a quick-disconnect second mount such as snap-on, magnets, hoop and loop fastener, etc.

Generally, the material for the CPR pad 204 is a matter of design choice but should be generally non-compressible, or minimally compressible, so it does not interfere with the compressing action of the device and the outer surface should be of a material that provides some friction when in contact with skin or clothing to aid in maintaining the position of the ram 220 on the sternum (e.g., avoid sliding).

A first embodiment of CPR pad 204 is shown in FIGS. 31, 32, 33, and 34, generally referred to by reference number 204-1. The CPR pad 204-1 includes a frame 508 having a pad 502 mounted thereon.

The CPR pad 204 is made from a soft material to allow the pad 502 to adopt a contour consistent with the sternum. It should be noted that the pad 502 extends to the edges to the frame 508 preventing the edges of the frame from contacting the sternum.

The frame 508 is rigid and defines an alignment guide 512 and a depression into which a magnet 504 is mounted. The magnet 504 is secured in the frame 508 by washer 518.

The alignment guide 512 on the CPR pad 204-1 interacts with an alignment channel 510 in a flange 516, which is attached to the inner sleeve 234 of the ram 220. The action of placing the CPR pad 204-1 on the flange 516 causes cooperating angles located on the CPR pad and flange 522, 524, respectively to interact forcing the CPR pad to self-center on the flange, which causes the alignment guide to locate in the alignment channel. In this illustrative example, the flange 516 is made of ferrous metal so it interacts with the magnet 504 to create a magnetic attachment.

Figure 35:
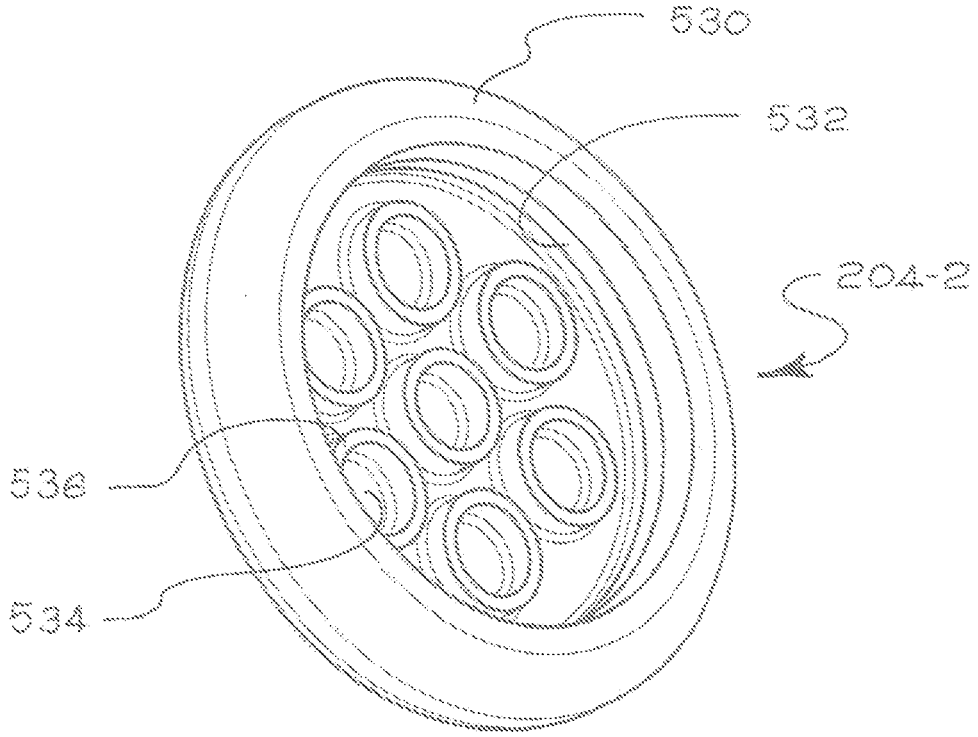
FIG. 35 is a perspective view drawing of a second embodiment of a CPR pad.
Figure 36:
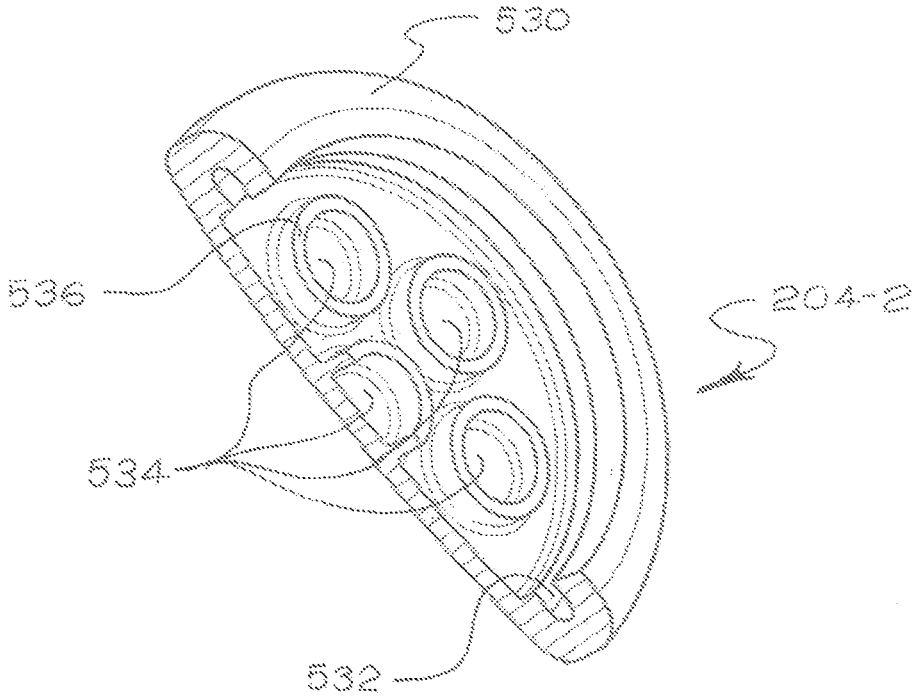
FIG. 36 is a cut-away perspective view drawing of the CPR pad shown in FIG. 34.

A second embodiment of CPR pad 204 is shown in FIGS. 35 and 36, generally referred to by reference number 204-2. The CPR pad 204-2 is made from a generally firm material that can be stretched.

The CPR pad 204-2 includes a body 530 that defines a retaining recess 532. It further includes multiple air pockets 534, each air pocket being of a cup shape and having a sealing surface 536.

In use, the CPR pad 204-2 is stretched over a flange (not shown) connected to the inner sleeve 234 of the ram 220. When placed on the flange, the sealing surfaces interact with a surface on the flange such that an air pocket is defined. When the CPR-pad 204-2 is compressed against the sternum, air will slowly escape from the air pocket; thereby, giving some degree of conformity of the CPR pad to the sternum. It should be appreciated that when the inner sleeve 234 of the ram 220 is retracting, the air pockets will refill with air as the CPR pad 204-2 returns to its normal configuration.

Figure 37:
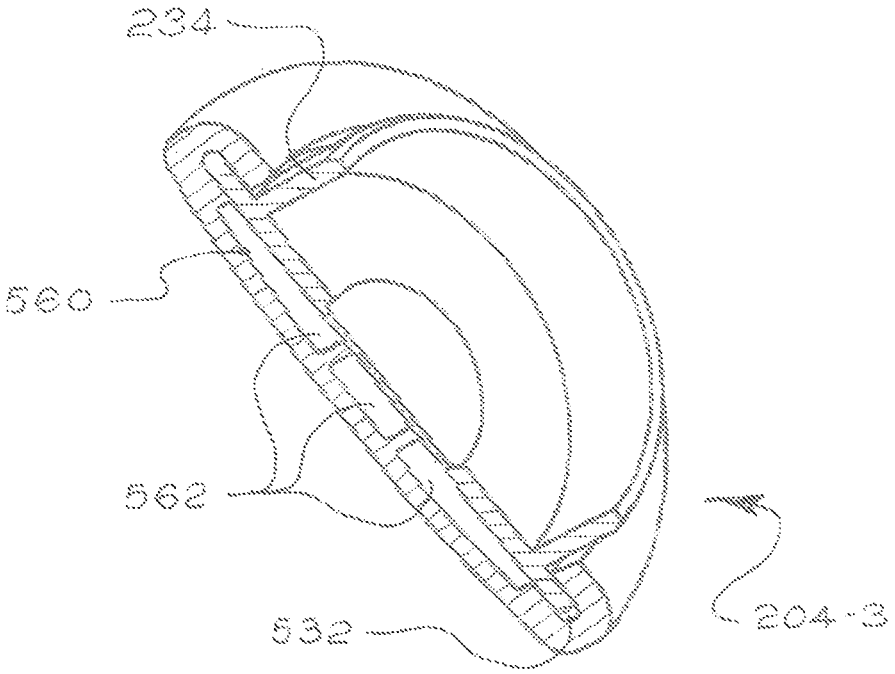
FIG. 37 is a cut away, perspective view drawing of a third embodiment of a CPR pad.
Figure 38:
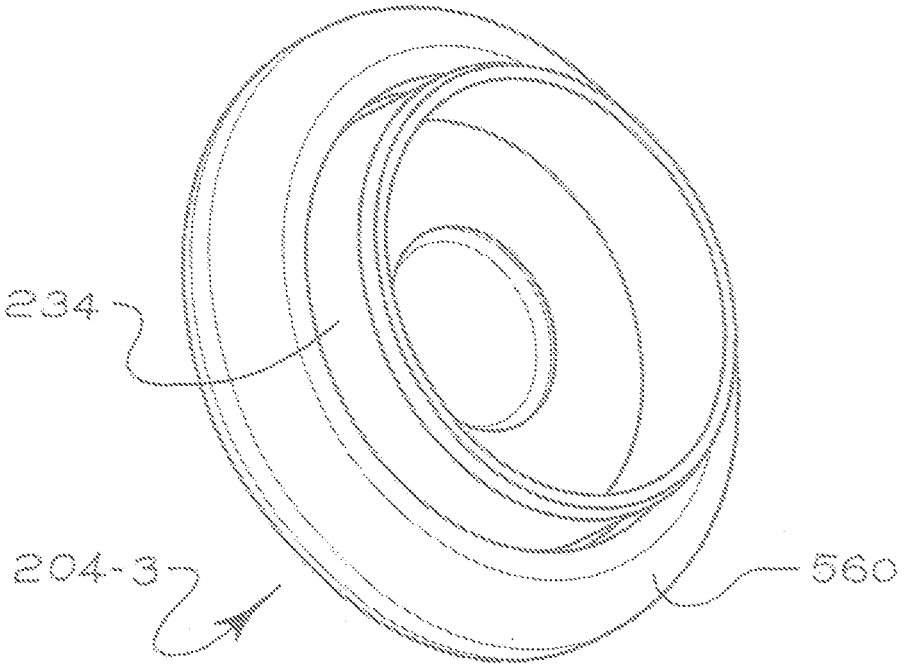
FIG. 38 is a perspective view drawing of the third embodiment of a CPR pad.

A third embodiment of CPR pad 204 is shown in FIGS. 37 and 38, generally referred to by reference number 204-3. The CPR pad 204-3 is similar to second embodiment of the CPR pad 204-2. Except in this embodiment, the pad 560 defines voids 562.

While the invention has been described above by reference to various embodiments, it will be understood that many changes and modification can be made without departing from the scope of the invention. In addition, the control system 350 contains a micro-processor with suitable components, such as memory, to retain and execute programming to carry out the above functions. The programming needed to accomplish the above functions is well known in the art, and the programming can be written based on the above provide functional capabilities. It is therefore intended that the foregoing detailed description be understood as an illustration of the presently preferred embodiments of the invention, and not as a definition of the invention. It is only the following claims, including equivalents, which are intended to define the scope of this invention.

What is claimed is:

1. An apparatus for providing cardiopulmonary resuscitation comprising:

a rigid frame assembly having a support assembly including an arch and a backplate, the arch and the backplate cooperating to define an opening dimensioned to permit placement of a human torso comprising a back and a sternum therein, the arch defining a bore, the bore passing through the arch and positioned in the arch to allow placement of the sternum generally below the bore when the back is positioned on the backplate, the bore having a lock integrated with the arch; and a compression module having a drivetrain, including a ram with a distal end, the ram connected to a motor by a drive, the drivetrain being capable of reciprocating the ram, and a housing supporting the drivetrain and at least a portion of the housing dimensioned to fit within the bore with an orientation permitting the distal end of the ram to be moved into a therapeutic position and to reciprocate the ram therefrom resulting in the performance of cardiopulmonary resuscitation by movement of the sternum relative to the back;

a computerized controller having a user interface for directing movement of the ram;

a power source electrically connected to the controller and the motor; and a quick-disconnect portion mounted on the at least a portion of the housing dimensioned to fit within the lock and suitable to engage the lock such that the compression module is removably secured in the arch by engagement of the quick-disconnect portion within the lock, and whereby the compression module is removable in its entirety by disengagement of the quick-disconnect portion from the lock.

2. The apparatus of claim 1 wherein the ram includes a cardiopulmonary resuscitation pad having an exterior surface for contacting the torso and the exterior surface defines the distal end of the ram.

3. The apparatus of claim 2 wherein the cardiopulmonary resuscitation pad has a quick-disconnect second mount for connecting and disconnecting of the cardiopulmonary resuscitation pad from the distal end of the ram, whereby replacement is easily accomplished.

4. The apparatus of claim 2 wherein the cardiopulmonary resuscitation pad is temporarily attached to the distal end of the ram.

5. The apparatus of claim 1 wherein the power source is line voltage.

6. The apparatus of claim 1 wherein the power source is a battery.

7. The apparatus of claim 6 wherein the battery has an enclosure and the compression module has a slot to receive the battery.

8. The apparatus of claim 7 wherein the enclosure and the slot each have a perimeter and the perimeters are shaped to permit the battery to be inserted in more than one orientation.

9. The apparatus of claim 1 wherein the drive is a linear drive.

10. The apparatus of claim 9 wherein the linear drive is a linear actuator.

11. The apparatus of claim 10 wherein the linear actuator is a ball screw.

12. The apparatus of claim 1 wherein the ram has telescoping segments.

13. The apparatus of claim 1 wherein the housing forms an enclosure having some portion of the drive train therein.

14. The apparatus of claim 1 wherein two latches secure the arch to the backplate.

15. The apparatus of claim 14 wherein at least one of the latches is a multi-disengagement latch.

16. The apparatus of claim 1 wherein the motor is an out-runner.

17. The apparatus of claim 1 wherein the quick-disconnect portion is self-locking.

* * * * *